US011387555B2

(12) United States Patent
Kaufmann et al.

(10) Patent No.: US 11,387,555 B2
(45) Date of Patent: Jul. 12, 2022

(54) MULTIBAND PATCH ANTENNA

(71) Applicant: u-blox AG, Thalwil (CH)

(72) Inventors: Thomas Kaufmann, Zurich (CH); Timo Saarnimo, Espoo (FI)

(73) Assignee: U-BLOX AG, Thalwil (CH)

( * ) Notice: Subject to any disclaimer, the term of this patent is extended or adjusted under 35 U.S.C. 154(b) by 97 days.

(21) Appl. No.: 16/568,791

(22) Filed: Sep. 12, 2019

(65) Prior Publication Data

US 2020/0106176 A1 Apr. 2, 2020

(30) Foreign Application Priority Data

Sep. 12, 2018 (EP) ..... 18194113

(51) Int. Cl.

| | |
|---|---|
| ***H01Q 9/04*** | (2006.01) |
| ***H01Q 5/10*** | (2015.01) |
| ***H01Q 5/50*** | (2015.01) |
| ***H01Q 1/38*** | (2006.01) |

(52) U.S. Cl.

CPC ..... *H01Q 5/10* (2015.01); *H01Q 1/38* (2013.01); *H01Q 5/50* (2015.01); *H01Q 9/045* (2013.01)

(58) Field of Classification Search

CPC .. H01Q 5/10; H01Q 5/50; H01Q 1/38; H01Q 9/045; H01Q 9/0428; H01Q 9/0435; H01Q 9/0457; H01Q 9/0464; H01Q 1/36

See application file for complete search history.

(56) References Cited

U.S. PATENT DOCUMENTS

| | | | | |
|---|---|---|---|---|
| 9,425,516 | B2 | 8/2016 | Chen et al. | |
| 2002/0190903 | A1* | 12/2002 | Watada | H01Q 1/38 343/700 MS |
| 2012/0186073 | A1* | 7/2012 | Feller | H01Q 9/28 29/600 |

(Continued)

FOREIGN PATENT DOCUMENTS

| | | |
|---|---|---|
| EP | 3 065 218 A1 | 9/2016 |
| WO | WO 2007/042938 A2 | 4/2007 |

(Continued)

OTHER PUBLICATIONS

Extended European Search Report, issued from the European Patent Office in corresponding Application No. EP 18 19 4113.9, dated Apr. 2, 2019, (8 pages).

*Primary Examiner* — David E Lotter

(74) *Attorney, Agent, or Firm* — Finnegan, Henderson, Farabow, Garrett & Dunner LLP

(57) ABSTRACT

A multiband patch antenna, a method for receiving radio frequency signals in multiple bands by a multiband patch antenna and a method of producing a patch element are disclosed. The antenna comprises a substrate layer having a first surface and a second surface and a base element on the first surface. A multi-resonance patch element comprising a pattern of outward extending resonance formations is provided on the second surface. At least two proximity feed elements configured for connection to a multiband hybrid coupler circuit and extending within the substrate layer from the first surface to the second surface are also provided. The multi-resonance patch element is configured to leave areas where the proximity feed elements extend to the second surface uncovered by the multi-resonance patch element.

17 Claims, 24 Drawing Sheets

(56) References Cited

U.S. PATENT DOCUMENTS

| | | | | |
|---|---|---|---|---|
| 2013/0088398 | A1* | 4/2013 | Utagawa | H05K 1/0243 343/745 |
| 2014/0210678 | A1* | 7/2014 | Chen | H01Q 13/10 343/725 |
| 2016/0352374 | A1* | 12/2016 | Wloczysiak | H04B 1/10 |

FOREIGN PATENT DOCUMENTS

| | | | |
|---|---|---|---|
| WO | WO 2014/008508 | A1 | 1/2014 |
| WO | WO 2014/036302 | A1 | 3/2014 |

* cited by examiner

MULTIBAND PATCH ANTENNA

FIELD OF THE INVENTION

This disclosure relates to patch antennas, and more particularly to multiband patch antennas.

BACKGROUND

Patch antennas are used in various applications. A characteristic of patch antennas is the compact size thereof. An example of applications where patch antennas have been found useful is global navigation satellite system (GNSS) receivers where compact low-cost antennas are particularly desirable. A type of patch antenna is a microstrip patch antenna (sometime called a printed antenna). The term microstrip patch antenna typically refers to a patch antenna construction fabricated using microstrip techniques on a printed circuit board (PCB). An individual microstrip antenna consists of a patch antenna on the surface of a PCB, with a metal ground plane on the other side of the board. A microstrip patch antenna is usually connected to a transmitter and/or receiver through microstrip transmission lines. In this description, unless otherwise mentioned or clear from the context, a reference to a patch antenna is a reference to a microstrip patch antenna.

Patch antenna designs that support dual-band and RTK L-band operations are being developed. Conventional designs of multi-mode patch antennae use stacked patch antennae for each band. These can be cumbersome and expensive to manufacture.

U.S. Pat. No. 9,425,516 discloses a patch antenna comprising a layered structure of a dielectric substrate and a dielectric multi-resonance patch layer covering the entire top surface of the layered substrate. The patch layer is provided with meandering lines comprising outwardly extending meandering slots. The patch antenna is adapted to provide dual-band coverage by combining patch mode and slot mode configurations. The antenna comprises two external proximity probe strips on the side of the lower layer of the substrate. The probe strips are shorter than is the thickness of the substrate such that the probe strips are not in contact with the patch layer on top of the substrate.

SUMMARY

Inventors have found that there are possibilities to make the manufacture of a compact patch antenna easier and more cost effective while the durability of a compact patch antenna can be improved and yet providing a well performing patch antenna.

According to an aspect there is provided a multiband patch antenna comprising a substrate layer having a first surface and a second surface, a base element on the first surface of the substrate layer, a multi-resonance patch element on the second surface of the substrate layer, the multi-resonance patch element comprising a pattern of outward extending resonance formations, and at least two proximity feed elements configured for connection to a multiband hybrid coupler circuit and extending within the substrate layer from the first surface to the second surface, wherein the multi-resonance patch element is configured to leave areas where the at least two proximity feed elements extend to the second surface uncovered by the multi-resonance patch element.

According to another aspect there is provided a method for receiving radio frequency signals in multiple bands by a multiband patch antenna comprising a substrate layer having a first surface and a second surface, the method comprising exciting a multi-resonance patch element on the second surface comprising a pattern of outward extending resonance formations by capacitive feeding of resonating energy to the multi-resonance patch element via at least two proximity feed elements connected to a multiband hybrid coupler circuit and extending within the substrate layer from the first surface of the substrate layer to the second surface, wherein areas of the multi-resonance patch element where the at least two proximity feed elements extend to the second surface are uncovered by the multi-resonance patch element, and enabling simultaneous reception of different bands by the multiband hybrid coupler circuit.

According to yet another aspect there is provided a method for manufacturing a patch antenna comprising a substrate having a first surface and a second surface, a base element on the first surface of the substrate layer, a patch element on the second surface of the substrate, the patch element comprising a pattern of outward extending resonance formations, and at least two proximity feed elements extending from within the substrate, the method comprising producing the patch element on the second surface using an additive manufacturing technology such that areas of the second surface where the at least two proximity feed elements extend to the second surface remain uncovered by the patch element.

At least a part of the patch element may be produced by printing pre-metallized high electric paste on the second surface. Some of the pre-metallized high electric paste may be removed from the second surface. The removal may be done to fine tune at least one band of a multiband patch antenna.

In accordance with a more specific aspect the multi-resonance patch element is symmetrically shaped to cover only a part of the second surface such that at least one uncovered area is provided where the at least two proximity feed elements can freely extend to the second surface.

The multi-resonance patch element may be configured to have a surface area that is smaller than is the area of the second surface of the substrate layer. The dimensioning can be such that resonant fields caused by the multi-resonance patch element are for the most part constrained within the substrate layer.

The multi-resonance patch element can comprise cut-outs configured to leave parts of the second surface uncovered. The periphery of the multi-resonance patch element can be arranged to substantially coincide with the periphery of the substrate element, the cut-outs providing the areas uncovered by the patch element within the periphery of the substrate element where the at least two proximity feed elements extend to the second surface.

The substrate layer may comprise a cylindrical substrate element of dielectric material with moderate relative permittivity. The substrate layer may also comprise a rectangular substrate element of dielectric material with moderate relative permittivity. A circular multi-resonance patch element with a radius that is smaller than the radius of the cylindrical substrate element or smaller or the same as the length of the side of the rectangular substrate element may be provided. This can be arranged to provide at least one uncovered area where the at least two proximity feed elements extend to the second surface.

The substrate layer may comprises ceramic material with relative permittivity, $\varepsilon r$, from 9.2 to 20.0. The relative permittivity may be arranged to be in the order of $\varepsilon r=9.5$. According to another possibility $\varepsilon r=15$.

The at least two proximity feed elements may be located approximately on the centre lines of the outwardly extending formations of the multi-resonance patch element. Alternatively, the feed elements may be located approximately on lines extending between the two outwardly extending formations.

The at least two proximity feed elements may comprise pins placed in apertures within the substrate layer. Landing pads may be provided at the ends of the pins that extend to the second surface. The landing pads may have circular, elliptical, rectangular, and/or concave shape.

The base element may comprise a printed circuit board configured to provide the multiband hybrid coupler circuit. The multiband hybrid coupler circuit may comprise a dual-band or a wideband hybrid coupler, a diplexer between different bands, at least one surface acoustic wave (SAW) filter, at least one low-noise amplifier (LNA) and a combiner.

The multiband patch antenna may be configured to operate at least in two of L1, L2, L5a, L5b, L6, RTK-L, and L-band RTK correction service bands.

The pattern of outward extending resonance formations may comprise meandering lines configured to provide a star shaped formation and/or a snowflake shaped formation. An arrow headed asterisk shaped formation is also possible.

A multi-resonance patch element may comprise at least one fine-tuning formation.

BRIEF DESCRIPTION OF DRAWINGS

Various exemplifying embodiments of the invention are described below with reference to the attached drawings. Steps and elements explained herein in an embodiment may be reordered, omitted, and combined to form different embodiments and any step indicated as performed may be caused to be performed in another order. In the drawings.

DETAILED DESCRIPTION

Figure 1:
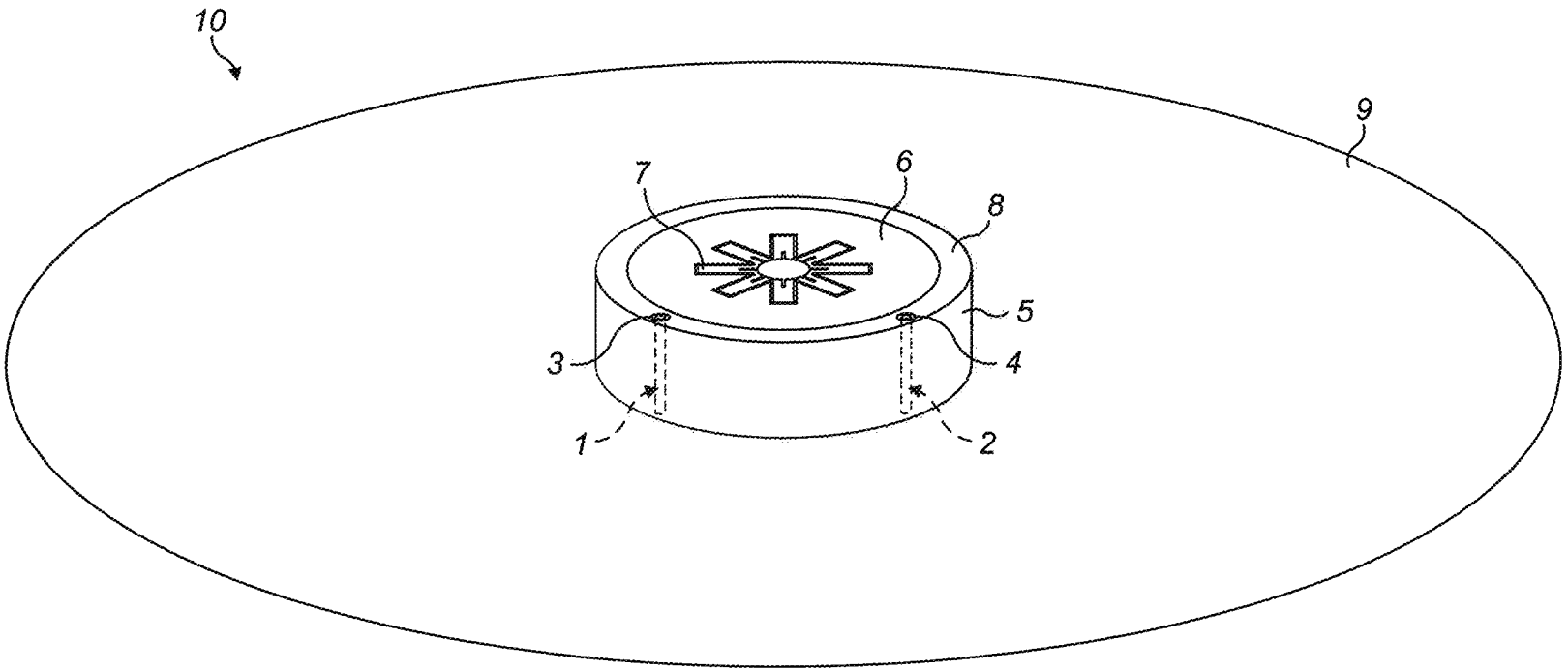
FIG. 1 is a perspective view of an example of a multiband patch antenna.

In the following certain detailed examples in relation to multiband patch antennas embodying the invention will be described with reference to the appended drawings. The described multiband patch antenna construction is easy to manufacture and possesses a good mechanical stability. More particularly, the following examples describe compact low-cost GNSS antenna topologies that can be used to cover multiple bands. Non-limiting examples of the bands are L1 and/or one or more lower bands (L2, L5 (divided to L5a, L5b), L6) and/or the RTK L-band.

In the disclosed multiband patch antenna a dielectric substrate layer with a first surface and a second surface is sandwiched between a base element providing a ground plane and a conductive multi-resonance patch element. The multi-resonance patch element is configured to provide a pattern of outward extending resonance formations. In certain exemplifying patch antenna apparatuses the multi-resonance patch can comprise a meandering slot line for achieving multi-resonance effect.

At least two proximity or capacitive feed elements passing from the first surface to the second surface through the substrate material layer are also provided. Patch antennas typically have very high impedances at the edges, and a capacitive gap can be used to reduce the effective impedance. The at least two proximity feed elements are configured for a connection to a multiband hybrid coupler circuit. An aim is to match the impedance at the feed point on the patch to the impedance at the feed element. The closer the feed element gets to the actual metallic patch, the more the currents on it will influence the resonances (frequency, polarization purity, impedance) on the patch.

The multi-resonance patch element is configured to leave areas where the at least two proximity feed elements extend to the second surface uncovered by the multi-resonance patch element.

A more detailed example of a multiband patch antenna 10 is shown in FIGS. 1 to 5. The multiband patch antenna comprises a single circular ceramic substrate layer 5. A first planar surface 11 of the substrate layer 5 is placed on a base 9. The base can comprise a ground plane and/or a printed circuit board (PCB) and so on, as will be explained in more detail later. According to an example the diameter of the substrate layer 5 can be in the order of 36 mm and the thickness in the order of 10 mm. It shall be appreciated that the dimensions may vary from this depending on the application and materials used.

The substrate layer material can have moderate permittivity. It is noted that in the context of the current invention terms 'relative permittivity', 'dielectric constant' and '$\varepsilon_r$' can be understood to mean the same characteristic. Commercial mass-produced and relatively cheap materials suitable for the substrate typically have relative permittivity up to 9.8. An example of such material is 92% alumina, which has relative permittivity of 9.2. Pre-metallized materials are also commercially available, the relative permittivity $\varepsilon_r$ of these typically going up to 13. Mass-produced materials with relative permittivity up to 15 are also known but these are not available with pre-metallization that could be used as PCB materials as standard. Materials with lower relative permittivity values are cheaper but may require use of a larger substrate.

The inventors have found a multiband patch antenna configured according to the herein disclosed principles perform well when the relative permittivity is within the range from 9.2 to 20. Relative permittivity of about 15 has been found to be a good tradeoff between the bandwidth and the size of the antenna. $\varepsilon r=9.5$ has also shown to give feasible performance in various applications.

Moderate relative permittivity/dielectric constant assists in the multiband patch antenna exhibiting multiple of resonances with sufficient bandwidth to cover, e.g., a lower band ($1^{st}$ resonance) and both L1-band and RTK L-band ($2^{nd}$ resonance). Use of a single substrate material element with moderate relative permittivity has proven in simulations to provide sufficiently large bandwidth to cover e.g. L1+RTK L-band in one resonance.

A circular metallic multi-resonance patch 6 is placed on top of the second surface 12 of the substrate layer 5. The patch exhibits multiple resonances at the frequency bands of interest through a slot line providing capacitive loading by means of a pattern of outward extending resonance formations 7.

Figure 2:
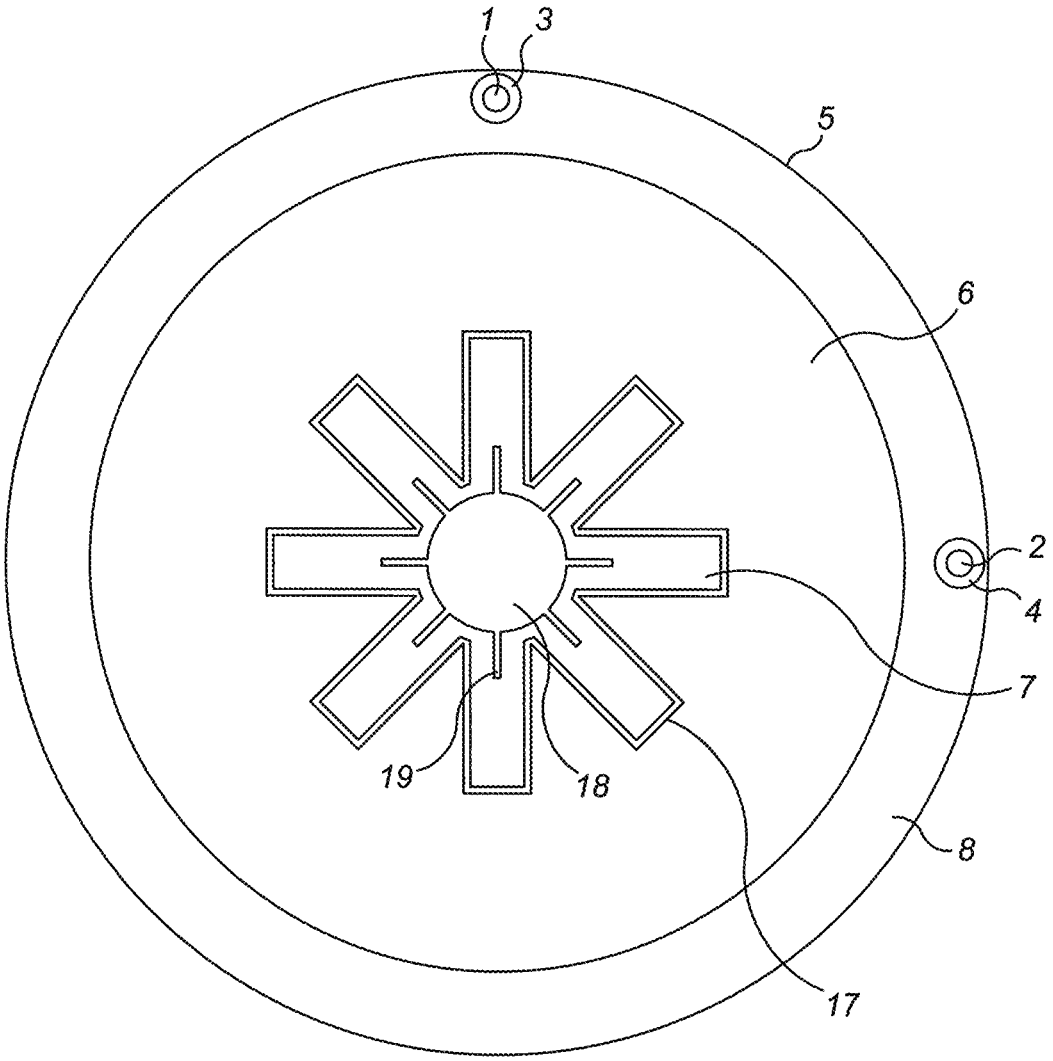
FIGS. 2 to 5 are views of the multiband patch antenna of FIG. 1.
Figure 8:
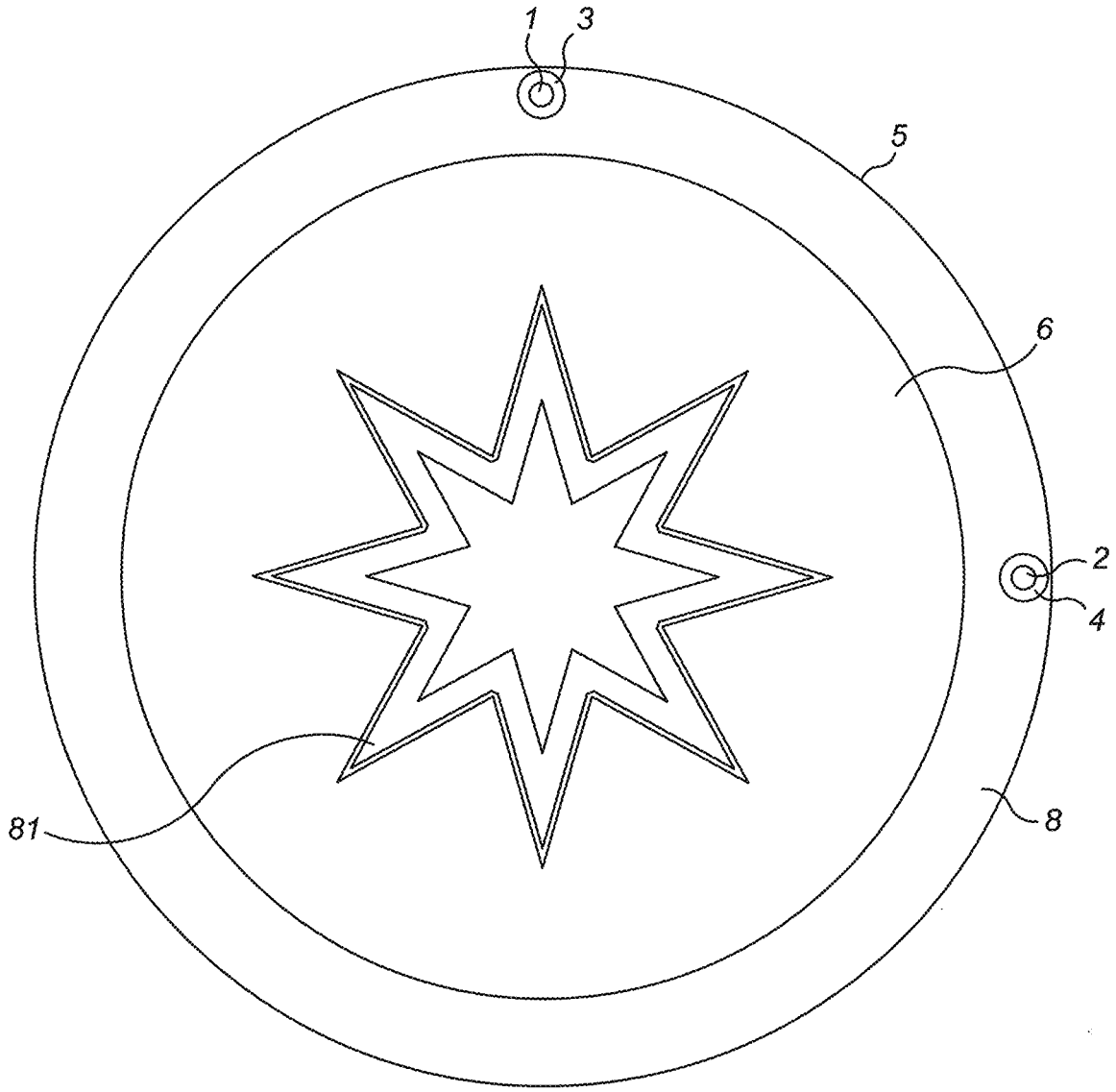
FIGS. 8 to 10 show examples of possible alternative resonance formations of a patch element.
Figure 9:
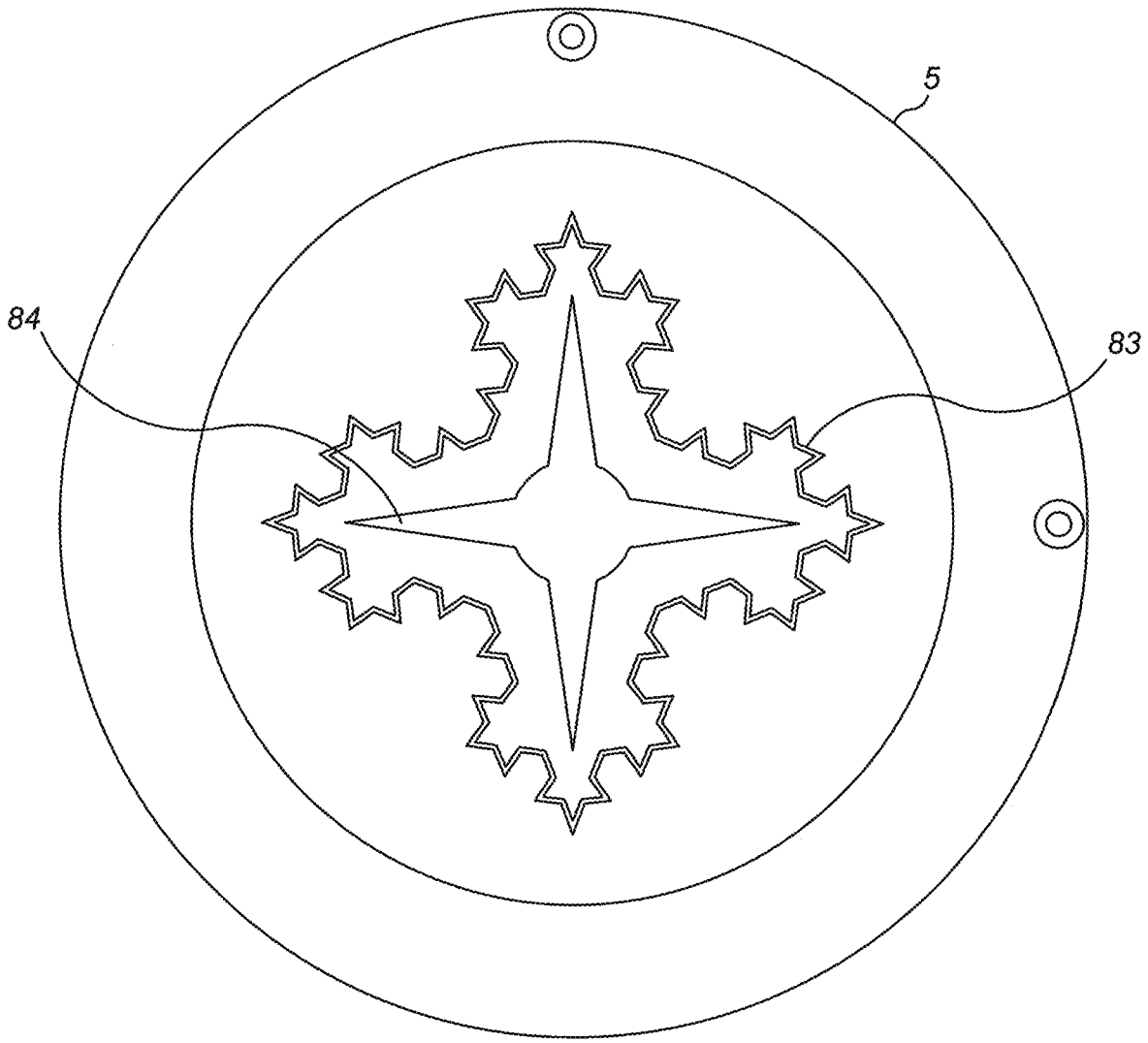

FIGS. 1 and 2 illustrate how the formations can be provided by a multiple of meandering slot lines 17. The meandering slots of the example are of rectangular shape. Non-limiting examples of alternative shapes are shown in FIGS. 8 and 9. The formation within the metallic multi-resonance patch 6 can be a symmetrical structure of slot lines 17. In the shown examples individual slots 17 are angled by 45 degrees but this is not the only possibility.

A circular cut-out 18 is provided in the center of the multi-resonance patch layer 6. The cutout can be provided with arms 19 of equal length. The cut-out can be used for shaping the resonant modes as it can be used for varying the current distribution, and hence the resonance frequency. Thus the cut-out provides another tuning parameter to achieve desired resonances at the frequency bands of interest.

Figure 3:
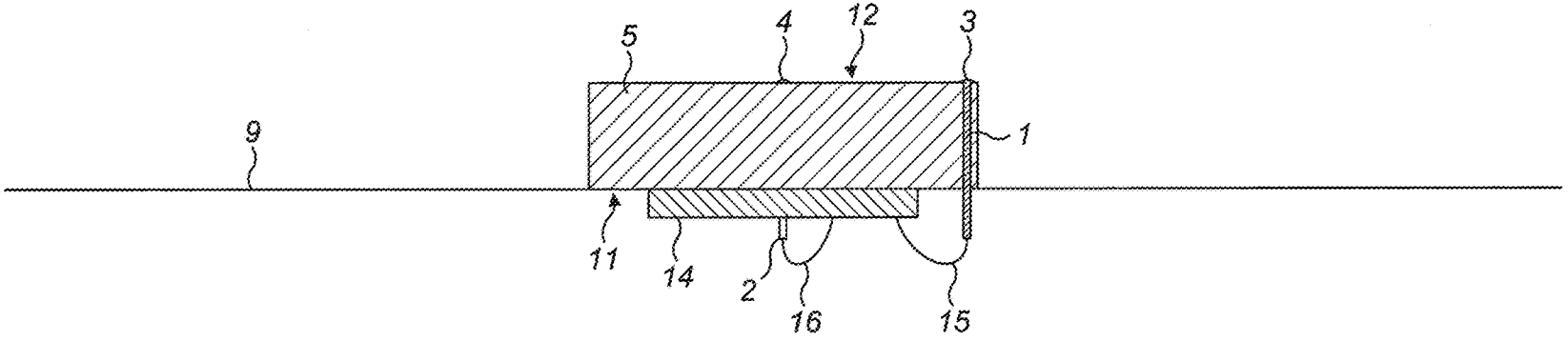

A multiband hybrid coupler circuit 14 may be attached to the ground plane 9. An example of this is shown in FIG. 3 cross sectioned side view of the microstrip patch antenna 10. A multiband hybrid coupler circuit may be provided as part of the RF circuitry and connected via lines 15 and 16 to feed elements 1 and 2. The RF circuitry may comprise a dual-band hybrid coupler, a diplexer between different bands, at least one surface acoustic wave (SAW) filter, at least one low-noise amplifier (LNA) and a combiner.

The substrate layer 5 is on top of a sufficiently sized ground plane (e.g. 150 cm radius). Appropriate circuits 14 are placed on the bottom side of the ground plane. In an embodiment a smaller ground plane is made from a printed circuit board (PCB) with the circuits on the bottom side of the PCB. The components can be enclosed in a housing.

Figure 4:
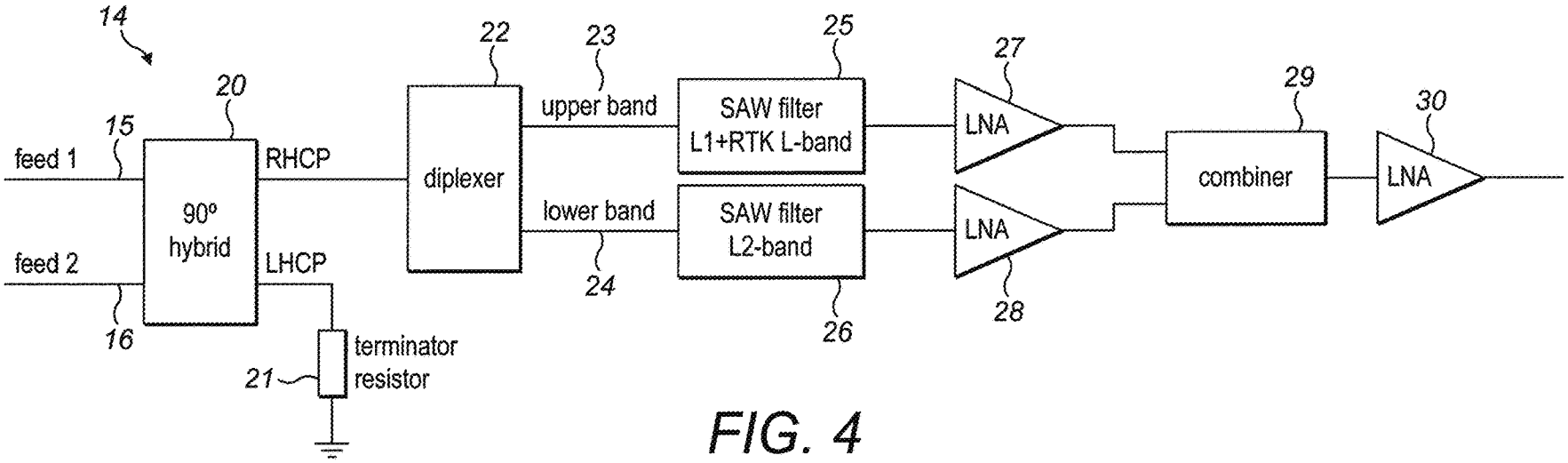

In the example shown in detail in FIG. 4 the circuit 14 comprises a RF circuitry configured to combine two feed signals on lines 15 and 16. The circuitry is further configured to filter and amplify signals. More particularly, the multi-band hybrid coupler circuit 14 comprises a hybrid coupler 20, a diplexer 22 between upper L1/RTK L-bands 23 and lower L2/L5 band 24 (e.g. a Wilkinson divider), two saw filters 25, 26, a linear amplifier (LNA) 27, 28 for each band, a combiner 29 and a further LNA 30. The hybrid coupler 20 can comprise a dual-band or a wide-band 90° hybrid coupler. A termination resistor 21 is also provided.

FIG. 3 also shows the proximity feed elements 1 and 2 extending through the substrate material layer 5, and landing pads 3 and 4. Proximity feed can be arranged through at least two proximity feed elements 1, 2 configured for connection via lines 15, 16 to the multiband hybrid coupler circuit 14. The proximity feed elements 1, 2 extend within the substrate layer 5 from the first surface 11 of the substrate layer 5 to the second surface 12, feed element 1 being shown sectioned. The proximity feed elements may comprise e.g. two metal pins extending through holes produced in the substrate layer. The length of the pins or the like feed elements can equate with the thickness of the substrate layer 5, or the pins can be slightly longer to facilitate connections to feed lines 15 and 16 and possible landing pads 3 at the top ends.

Two proximity feed elements can be placed at a 90 degree angle from the center.

The antenna may be fed from the bottom with a coaxial feed from which the feed pins protrude.

The proximity feed elements can comprise a conductive part extending through the substrate material layer 5 and a wider top part at the second surface. The top part can be shaped to provide optimized capacitive effect. In this specification the top part of a feed element is called a landing pad. FIGS. 1 to 3 show landing pads 3, 4 at the top end of the respective pins 1, 2, i.e. at the second surface of the substrate layer. The landing pads for both feed pins can form a design parameter to achieve a good impedance match. FIG. 2 shows an example of the feed pins and circular landing pads from the top but other shapes are also possible.

The conductive multi-resonance patch element 6 can be configured such that areas where the at least two proximity feed elements extend to the second surface are left uncovered. In FIGS. 1 and 2 the uncovered area is provided by area 8. In this example the radius of the conductive multi-resonance patch element 6 is smaller than the radius of the substrate layer element 5. This leaves a ring of free surface for the proximity feed elements 1, 2 to extend to the surface 12 without being in physical contact with the multi-resonance patch element 6.

The area of the metallized multi-resonance patch part can be configured to cover a smaller area than is the surface area the substrate such that resonant fields are mostly constrained to the substrate material. When the substrate is physically larger than the metallic patch above the near fields can be to a large extent constrained inside the substrate. This can facilitate various housing designs and design freedom without need to factor in the effect of the near fields. The conventional thinking has been that to achieve minimal antenna size, the metal patch has to cover the whole upper surface. However, a patch antenna can have a substrate that is larger than the metal patch to constrain the fringing electrical field into the substrate, this being an acceptable trade-off between these two factors.

The antenna apparatus can be assembled using traditional patch assembly methodologies. Because of the design where the feeding is arranged via proximity feed elements extending within holes provided in the substrate layer there is no need for external feed elements and securing and protecting thereof. Manufacture of the through holes can be provided, e.g., by drilling, machining, laser cutting, waterjet cutting etc. technologies.

Figure 5:
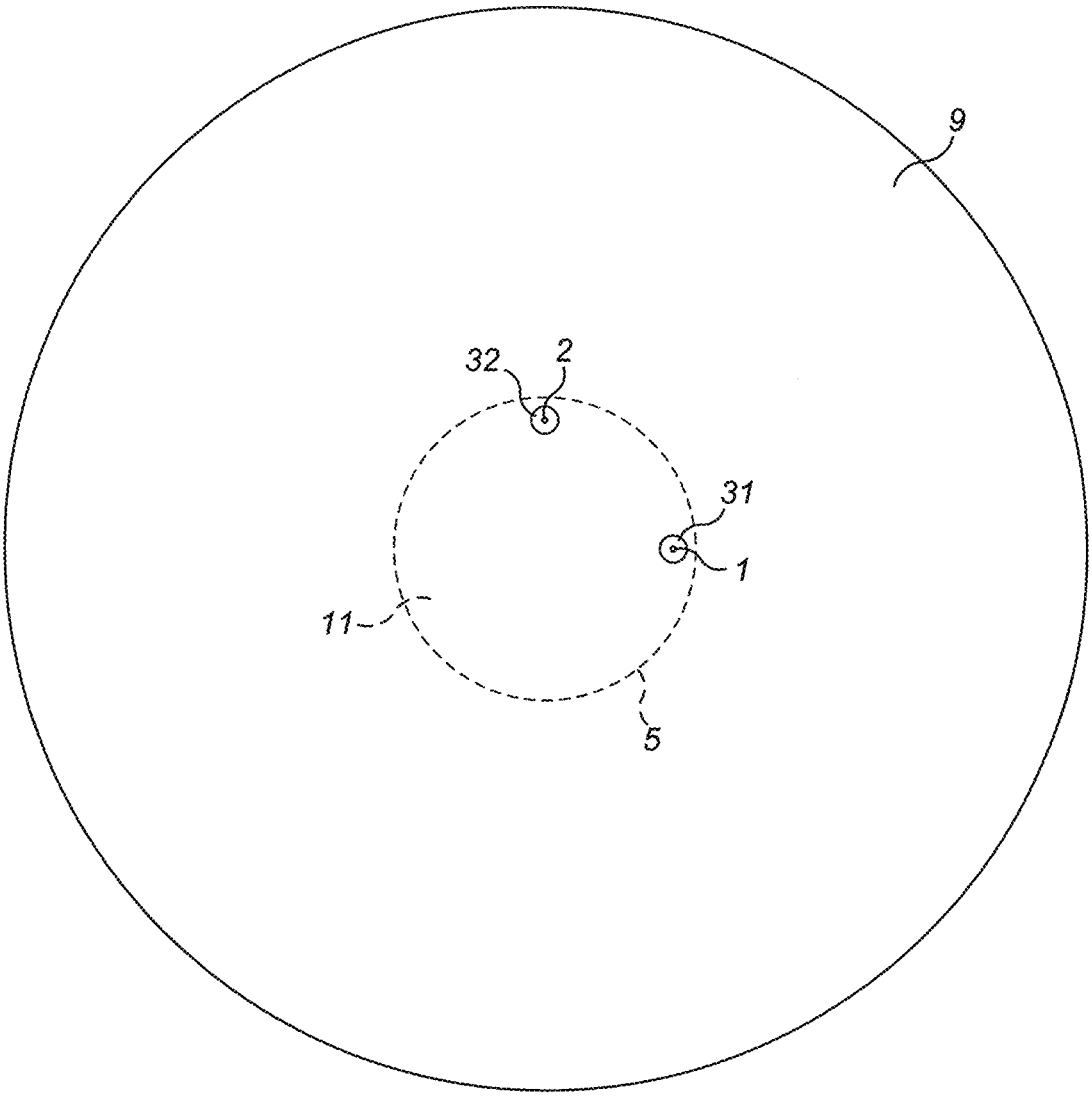

FIG. 5 shows a bottom view of the patch antenna 10. Cut-outs 31 and 32 are provided in the ground plane 9. The diameter of the cut-outs can be arranged to be suitable to exhibit a 50 Ohm impedance, or another suitable impedance, depending on the feed pin radius and the coaxial feed substrate material. The periphery of the substrate 5 is indicated by the dashed line. The ground plane does not necessarily need to be circular, other (e.g. rectangular) shapes are also suitable.

Figure 6:
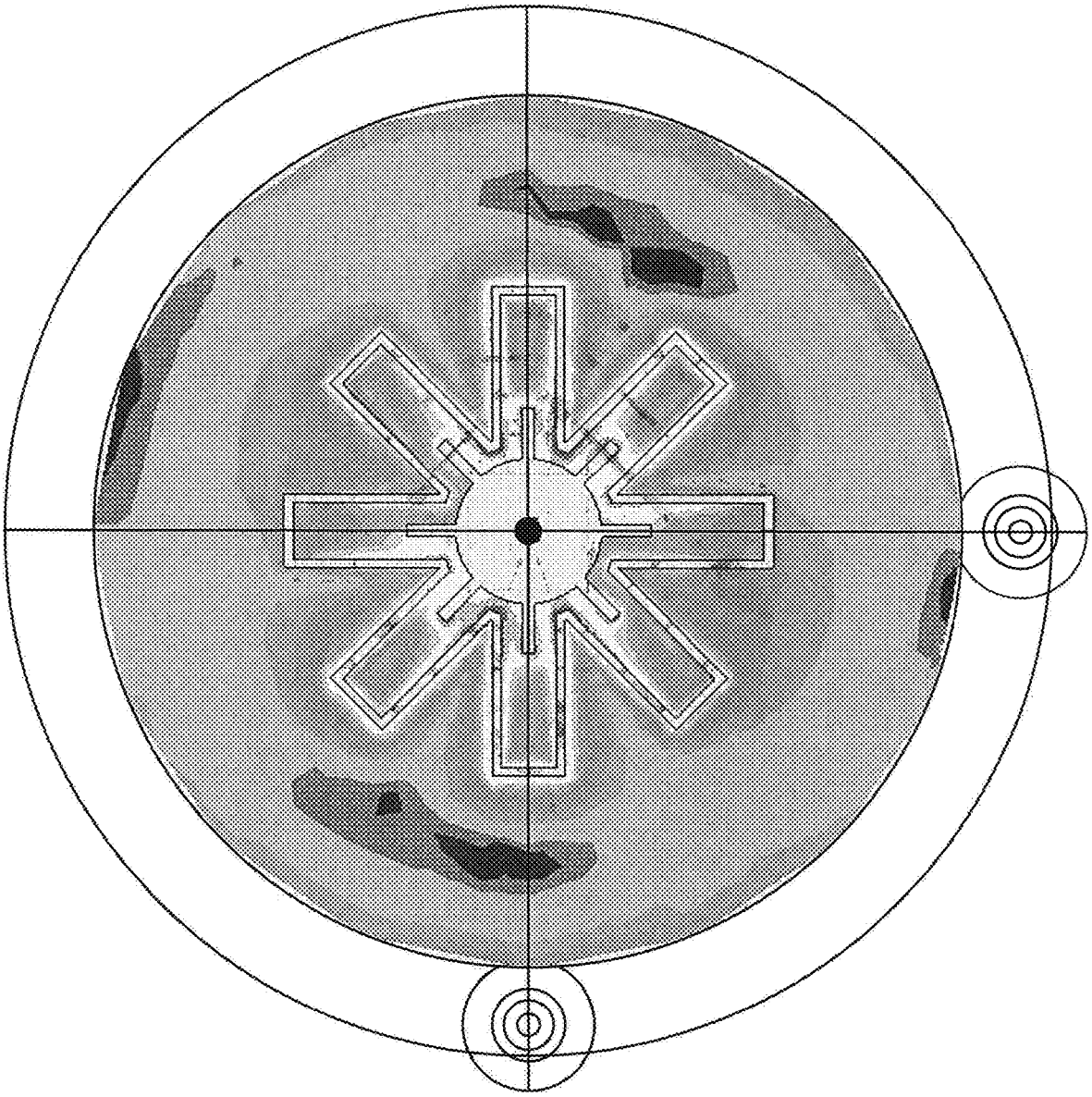
FIGS. 6 and 7 show instantaneous currents for two bands of the multiband patch antenna of FIGS. 1 to 5.
Figure 7:
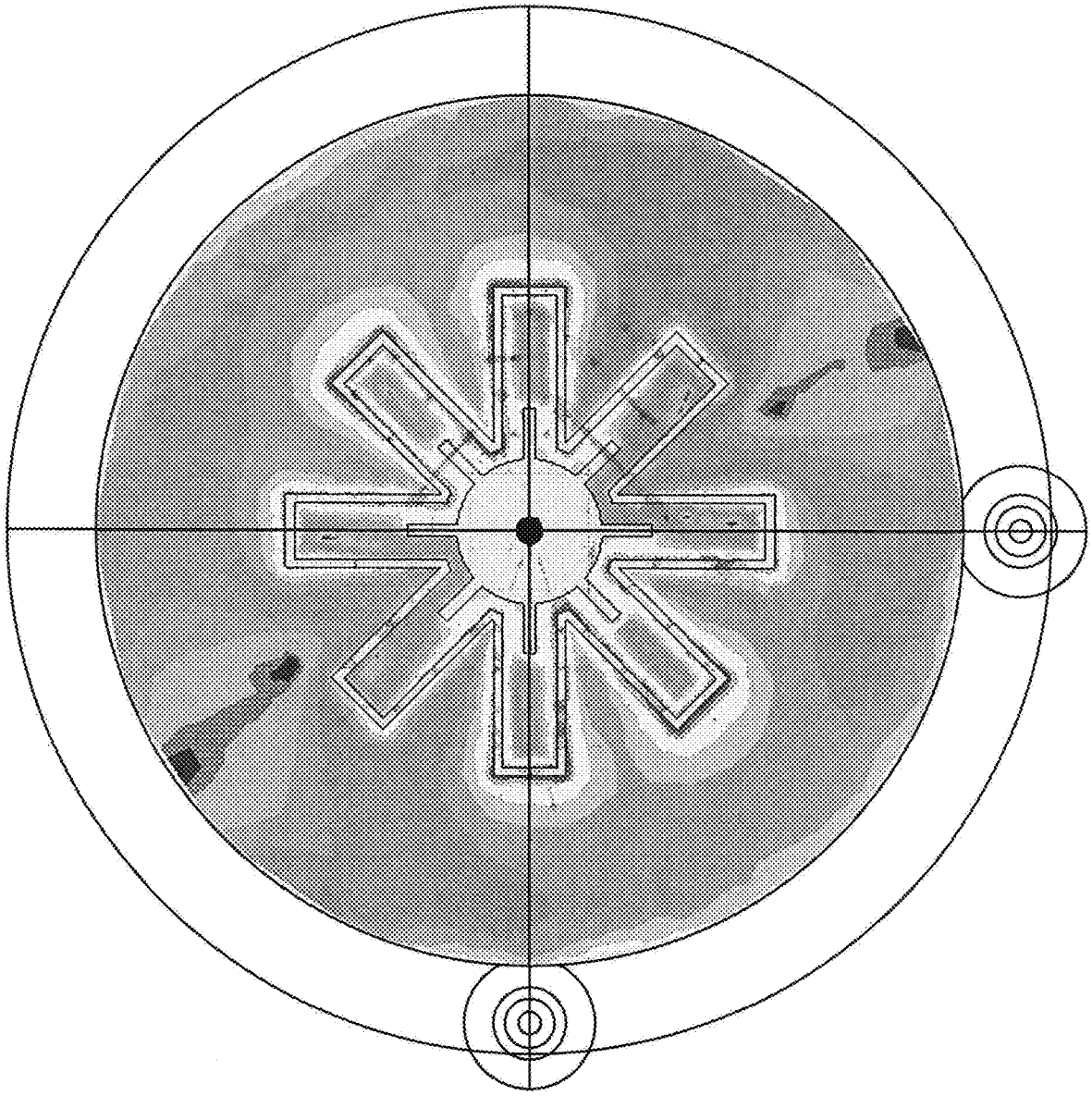

FIGS. 6 and 7 show examples of two resonant modes generated by the multiband patch antenna of FIGS. 1 to 5. FIG. 6 shows the instantaneous current at L1 (1575 MHz) and FIG. 7 at L2 (1.227 MHz). At L1, the currents are mostly concentrated towards the center of the circular metallic patch. At L2, the currents are mostly concentrated towards the meandering slot line.

Figure 10:
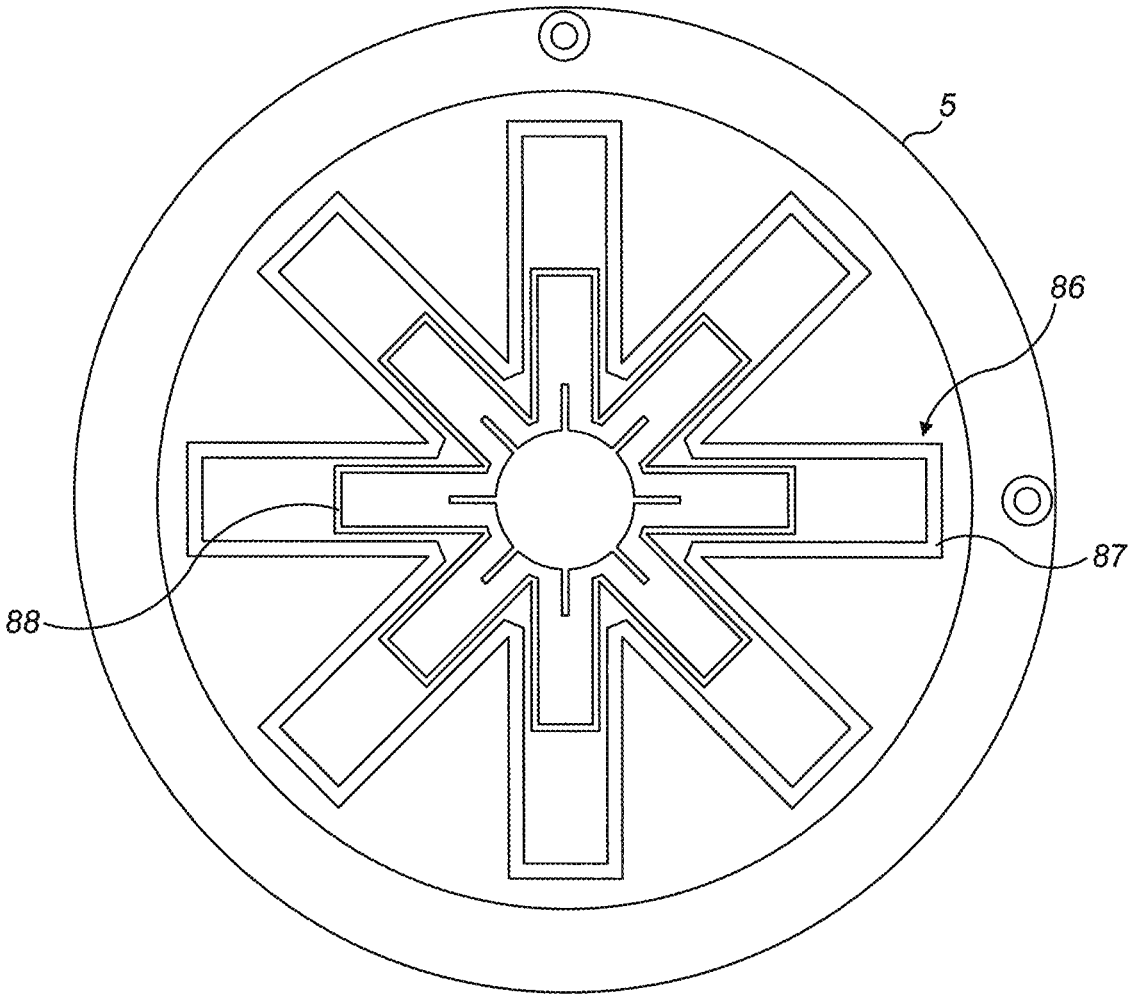

FIGS. 8, 9 and 10 show possible alternative resonance formations on a cylindrical substrate 5. Similarly to FIG. 2, the multiband patch antenna can comprise a symmetrically shaped multi-resonance patch element that covers only a part of the second surface, thereby providing at least one uncovered area where the at least two proximity feed elements extend to the second surface. The circular multi-resonance patch element can have a radius that is smaller than the radius of the cylindrical substrate layer thereby providing the uncovered area where the at least two proximity feed elements extend to the second surface.

In FIG. 8 the pattern of outward extending resonance formations 81 comprises meandering lines configured to provide a star shaped formation. An inner star shaped opening can be shaped similarly to the meandering lines.

In FIG. 9 a pattern of outward extending resonance formations 83 comprises meandering lines configured to provide a snowflake shaped formation. For example, the shape of a Koch snowflake may be provided. An inner opening 84 is shown to have a different, pointed configuration.

FIG. 10 exemplifies the possibility of having two sets of meandering lines 87, 88 arranged to provide a dual meandering slot line 86. The additional slot line can be used to extend the bandwidth of one of the two resonances and/or to introduce a third resonance.

FIGS. 11A to 13B show some further examples where the substrate layer comprises a square shaped piece of substrate material.

Figure 11A:
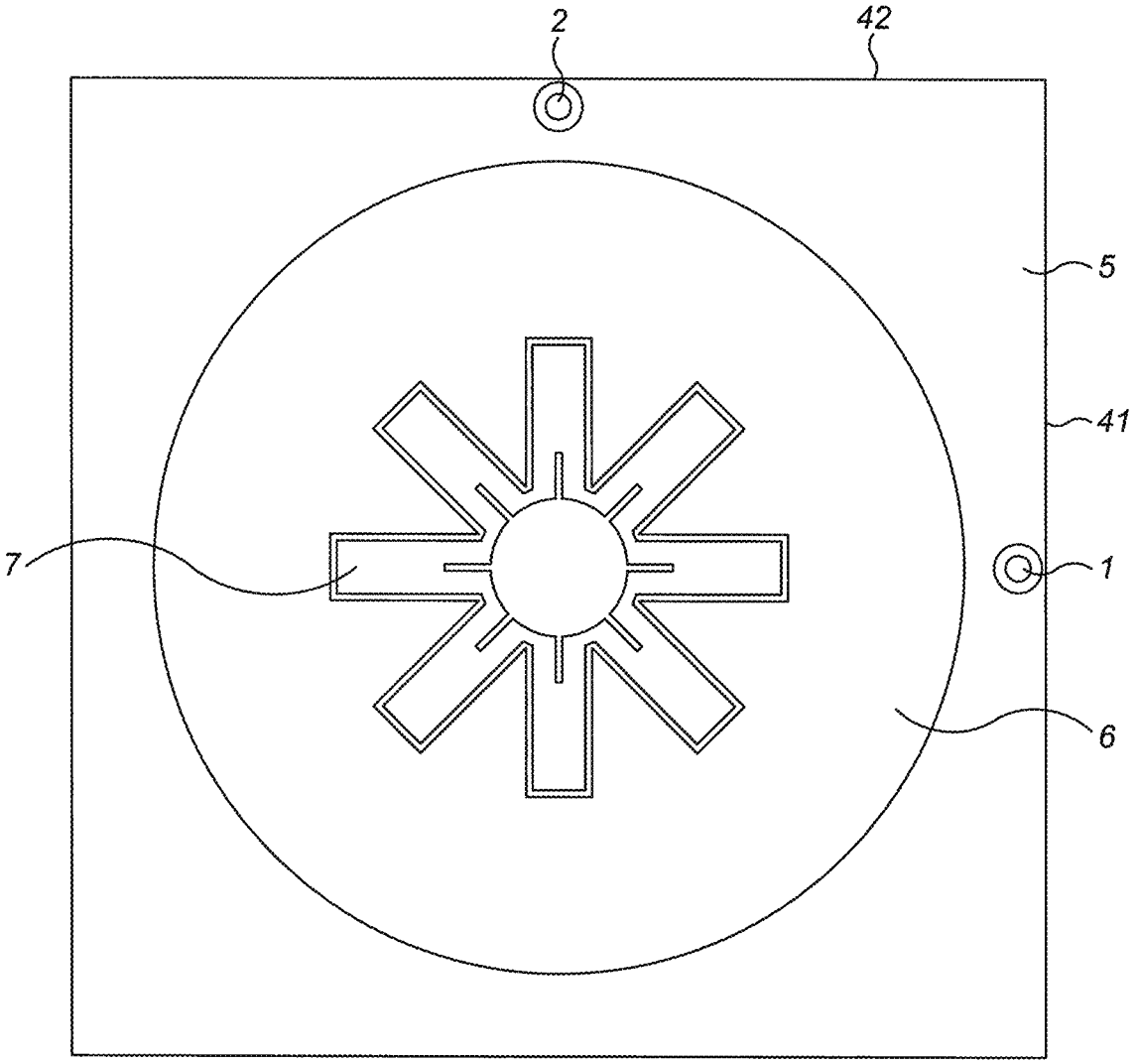
FIGS. 11A to 14 show further examples of possible multiband patch antenna configurations.
Figure 11B:
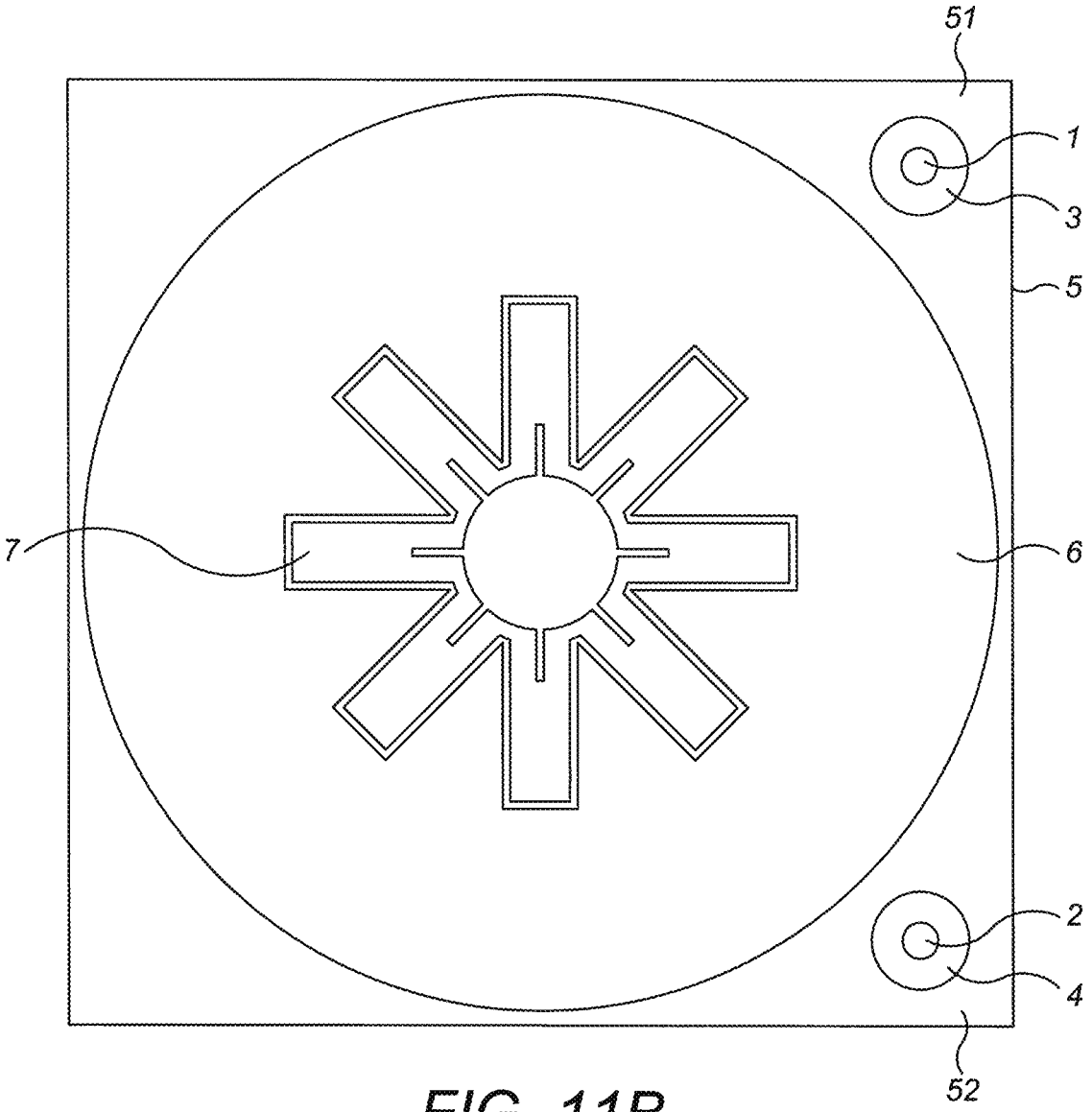

In FIGS. 11A and 11B a circular multi-resonance patch element 6 is placed on a square-shaped substrate 5. In FIG. 11A proximity feed elements 1 and 2 are placed substantially in the middle of the adjacent sides 41 and 42 of the substrate. In FIG. 11B proximity feed elements 1 and 2 are placed in corners 51 and 52 between adjacent sides of the substrate while the periphery of the circular patch element 6 extends substantially between the sides of the rectangular substrate 5. FIG. 11B construction facilitates a more compact antenna than that of FIG. 11A.

Figure 12A:
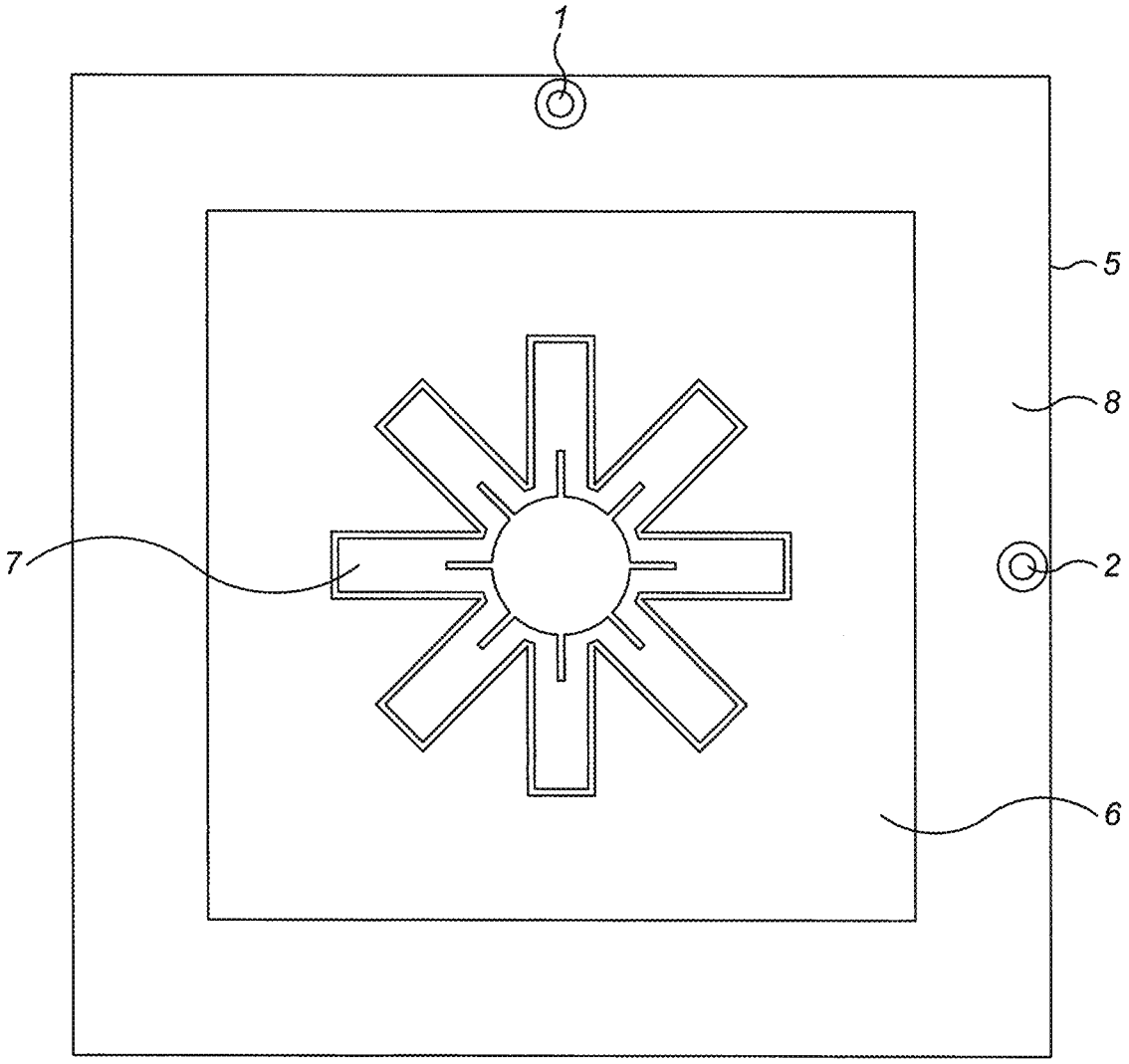

In FIG. 12A a square shaped multi-resonance patch element 6 with complex meandering line formation 7 is placed on a square-shaped substrate layer 5. Feed elements 1, 2 are shown to be located substantially in the middle of the sides of the uncovered surface area 8. The feed elements may also be placed differently, e.g., in the corner sections of the uncovered surface area 8.

Figure 12B:
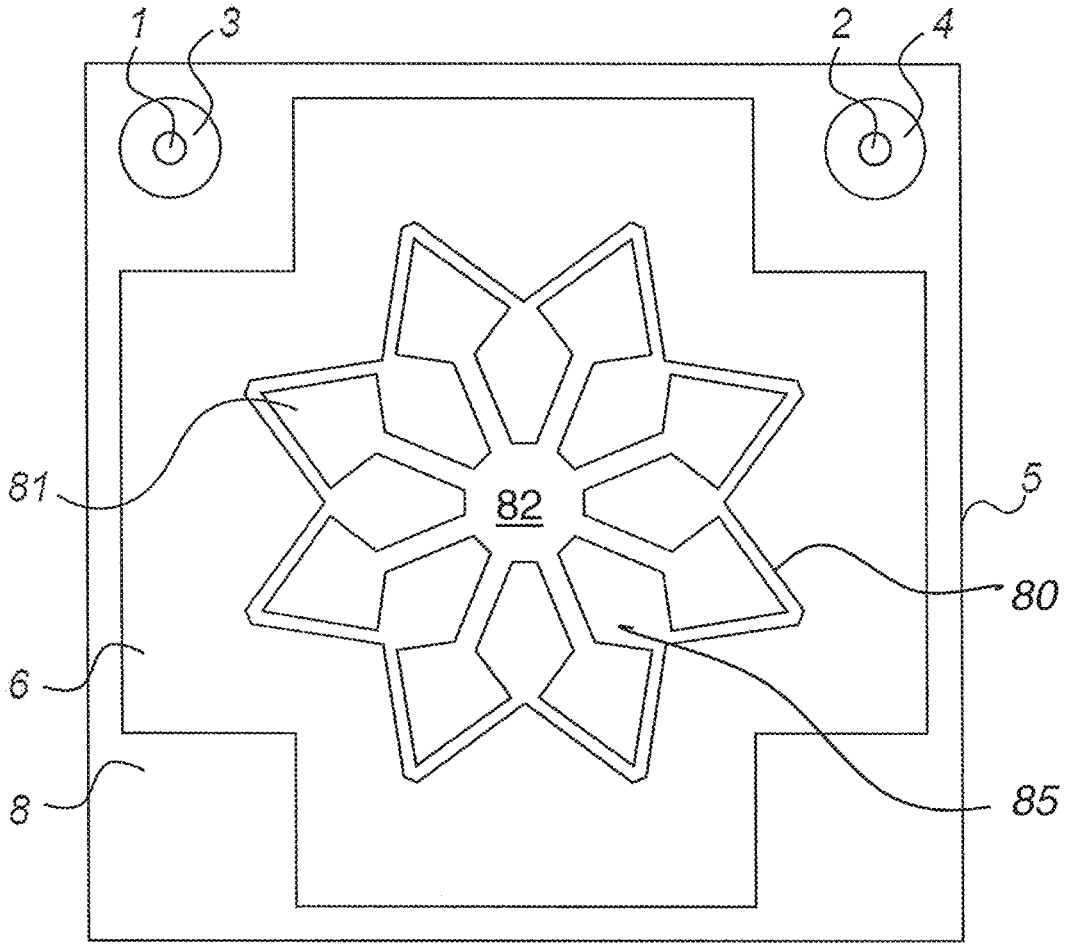
Figure 12C:
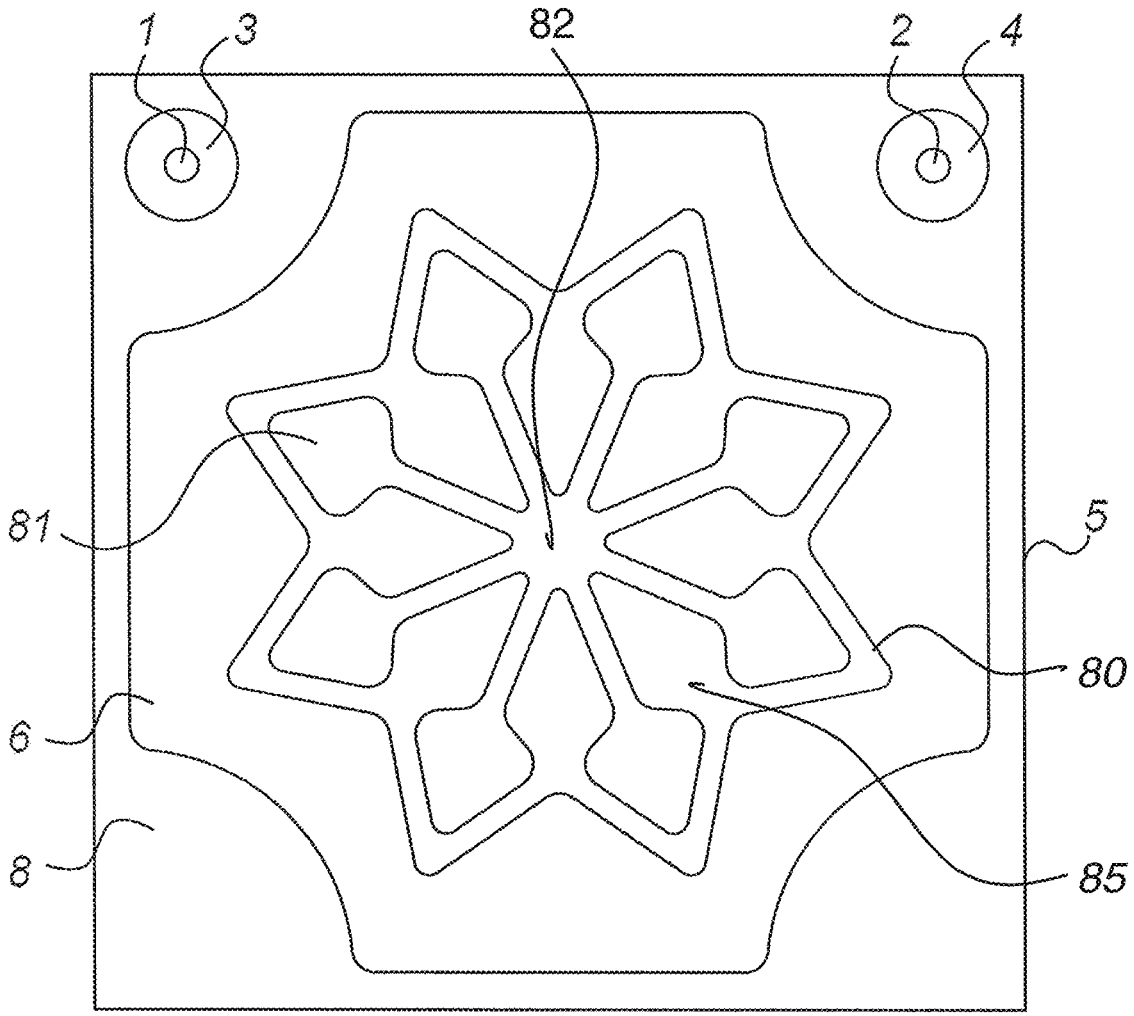

FIGS. 12B and 12C show examples where feed elements 1 and 2 are located in the corner sections of uncovered surface areas 8 of a substrate 5. In these examples a star-shaped resonance formation 80 is provided in the middle of the conductive patch element 6. An inner resonance element 82 comprising a pattern of outward extending formations 81 is produced within the star-shaped resonance formation 80. The inner resonance element 82 can be described as an arrow headed asterisk. The substrate 5 is exposed in areas 85 between the star pattern 80 and the inner resonance element 82.

The patch antenna of FIG. 12C is an example of a conductive patch element with rounded corners. The basic shape of the exemplifying patch element 6 resembles that of the example of FIG. 12B. Allowing smoother or rounded corners in a conductive patch element can be beneficial, e.g., for manufacturing reasons.

Feed elements can be positioned between the adjacent outwardly extending formations. In the examples shown in FIGS. 12B and 12C the feed elements 1 and 2 are positioned about the middle of the valleys between the outwardly extending tips or arrowheads 81 of the star-shaped formation 80, i.e., on lines (not visible in FIGS. 12B and 12C) that extend from corner to corner of the substrate 5 and through the center of the patch element 6. This may allow for a more compact design in certain applications.

Figure 13A:
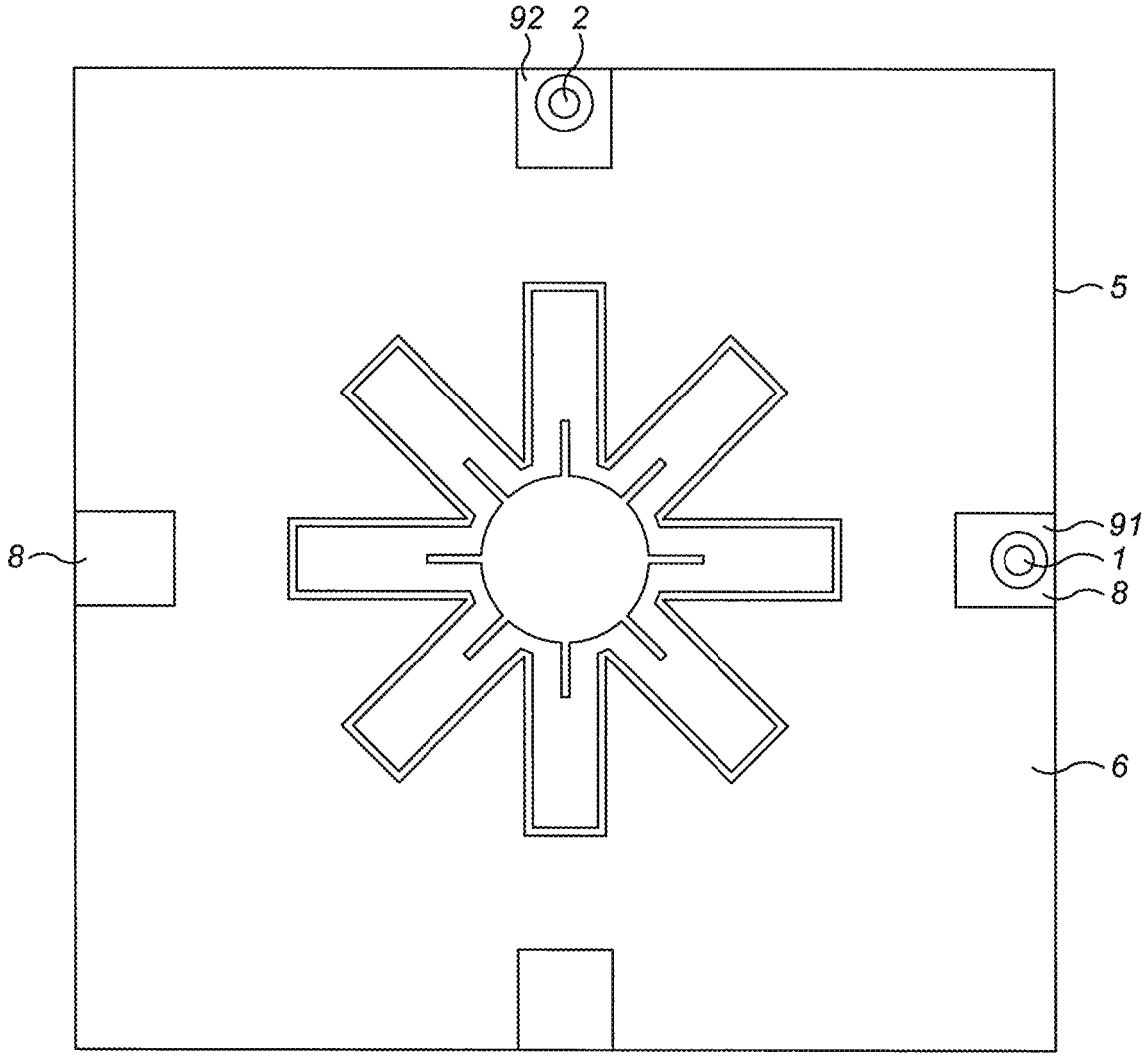
Figure 13B:
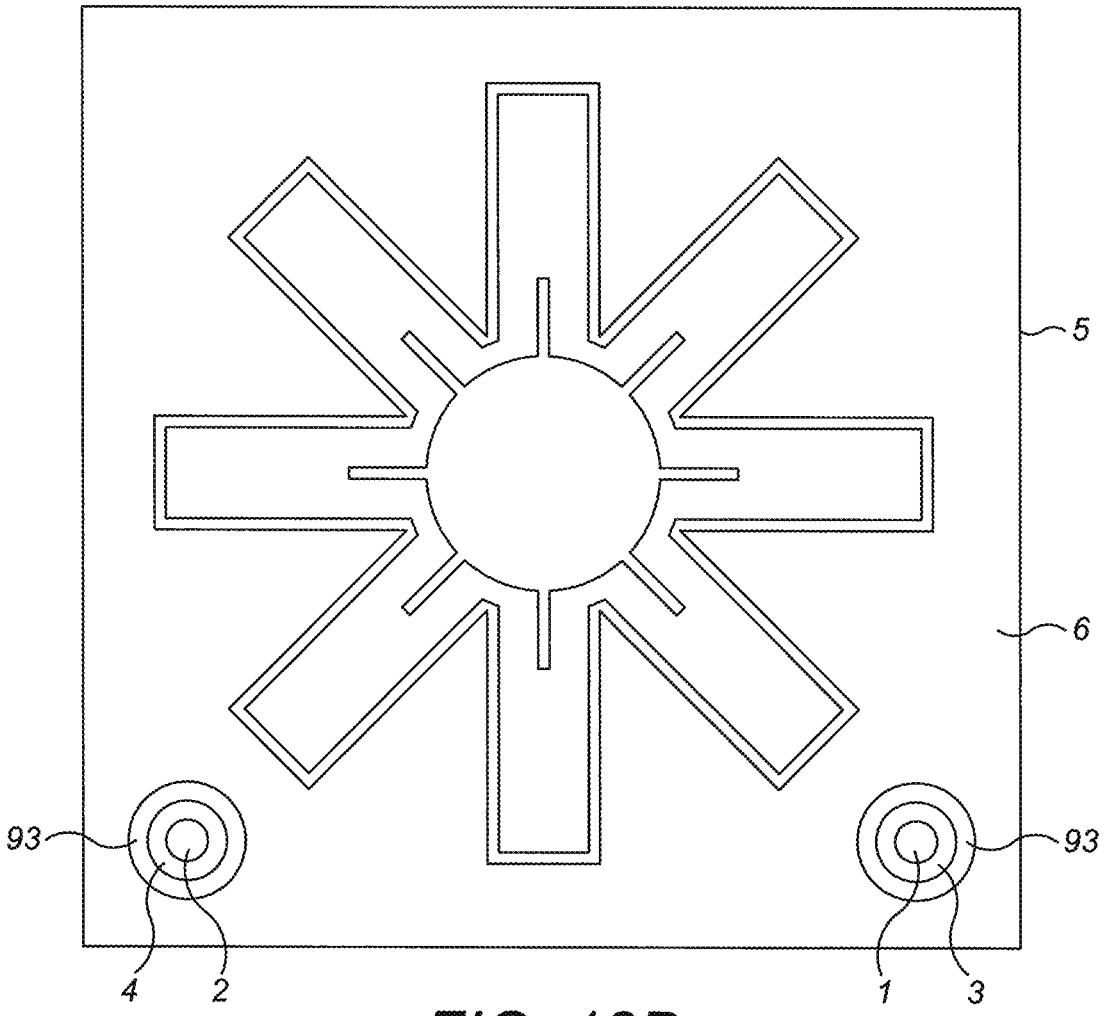

FIGS. 13A and 13B illustrate a multiband patch antenna where a multi-resonance patch 6 covers substantially the entire surface area of the substrate layer 5. The uncovered areas 8 for the feed elements 1, 2 are provided by cut-outs 91, 92. The cut-outs can be configured to leave parts of the second surface uncovered, e.g., in the shown symmetric fashion where each side has a cut-out. It is also possible to provide cut-outs only where the feed elements extend to the second surface of the substrate.

The cut-outs may be arranged in different locations, e.g., in the middle or the corner sections of the patch element 6. Examples of this are shown in FIGS. 11A, 11B, 12A, 12B, 12C and 13A. A further example of arranging cut-outs is shown in FIG. 13B where cut-outs are punched or otherwise produced as circular apertures 93 in the patch element 6 without the apertures opening to the edge of the patch element. Pins 1, 2 and the landings pads 3, 4 are placed within the uncovered area provided by the apertures 93 on the substrate.

The cut-outs can comprises any appropriately shaped aperture. For example, depending on the application, in addition to square or a circular, ellipsoid, rectangular, triangular, star shaped, snowflake shaped, or concave aperture exposing an uncovered area of the substrate can be produced.

Cut-outs exposing areas of the substrate surface can also be provided in differently shaped patch elements. For example circular, oval, triangular or rectangular patch elements can be provided with cut-outs for exposing surface of the substrate.

The periphery of a multi-resonance patch element can be dimensioned to substantially coincide with the periphery and surface dimensions of the substrate element. The cut-outs can then be used to provide uncovered areas where the at least two proximity feed elements are free to extend to the second surface. This configuration may facilitate a more compact antenna than where the exposed surface area surrounds at least a substantial portion the patch element. In case fringing electrical fields are of concern these can be addressed, e.g., by an appropriate housing arrangement.

The at least two proximity feed elements can be located relative to the patch element such that the proximity feed elements are approximately on the centre lines of the respective outwardly extending formations of the multi-resonance patch element.

In accordance with a possibility a multiband antenna is fine-tuned by removing small portions of the metallic material of the multi-resonance patch. By removing metallization at certain points to adjust the resonance frequency up and down, as desired.

Figure 14:
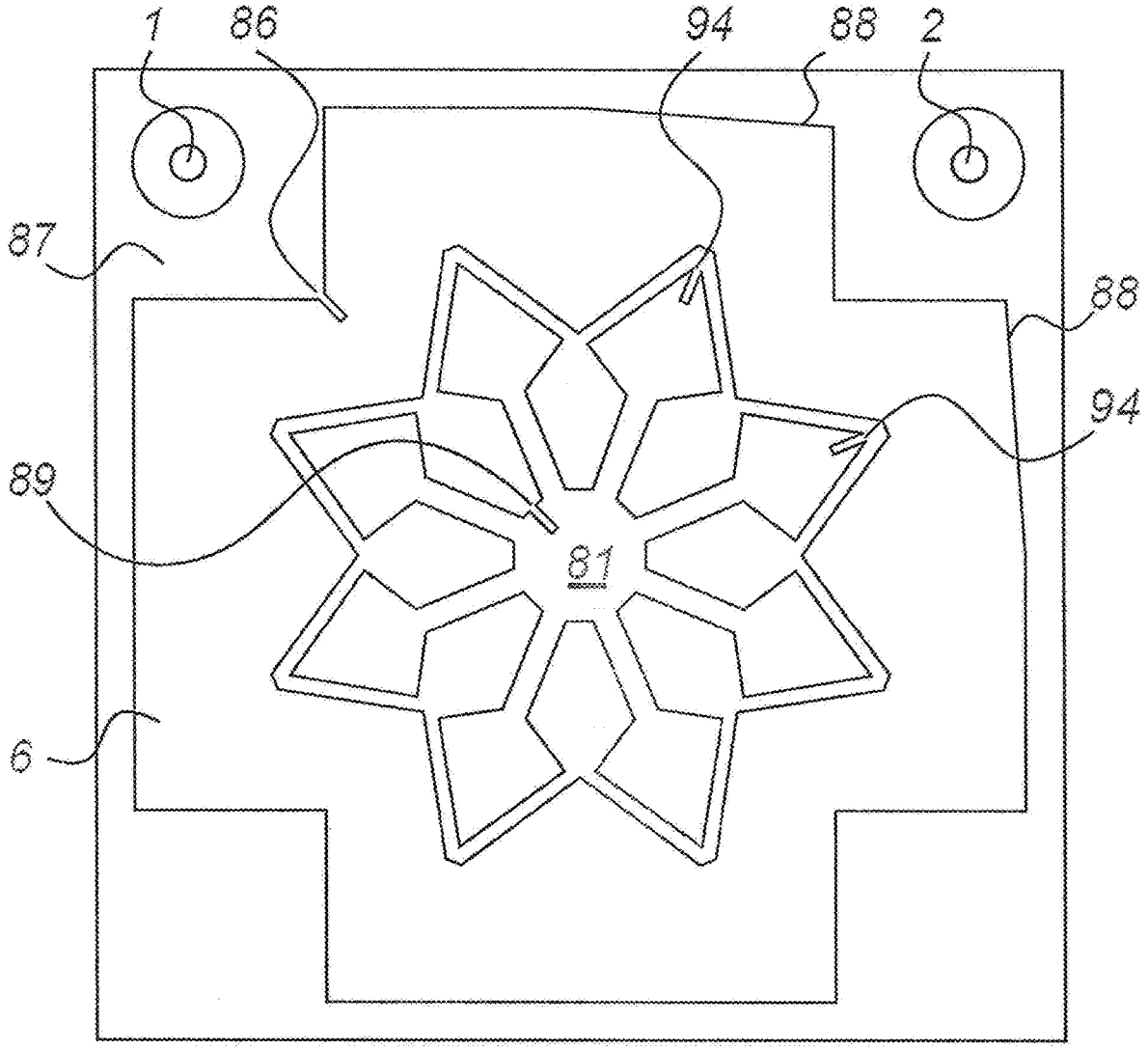

An example of adjusting resonance frequencies of an L1 and L5 band antenna is shown in FIG. 14. To lower the frequency of L5 band, feed element 2 (port 2) can be independently tuned by removing metallization of the patch element 6. In the example this is done by removing a small piece of metallization from corner 86 of the feed cutout 87 adjacent to feed element 1 (port 1). To bring the resonance up in L5 band, the overall area covered by the patch element material adjacent to the feed element 2 (port 2) can be reduced. In the example this is provided by slanting 88. The main motivation for this may be to influence the L5 band but this can also be used to slightly increase the resonance of the L1 band.

Resonance of the L1 band can be lowered by removing a part of the metallic material at the centre part 82 of the arrow like structure. In the example material is removed, to tune feed element 1 (port 1) from a location 89 that is towards feed element 2 (port 2). This can also be done to lower resonance at L5 band of port 1. The resonance frequency of L1 band can be increased by removing material from the tips of the adjacent arrow shaped formations. Such removal of material is denoted by reference 94.

Removal of material at 94 can also be used to increase the L5 band resonance. It has been noted that the effect on the resonance at the L1 band is most pronounced with modifications that are less than 1 mm with regards to the length. The width of these strips (except for L5 up) may be e.g. in the order of 0.5 mm. Wider strips may have a more pronounced effect and the length can be less. The removal and/or other tuning operations may be provided by a manual process with measurement equipment attached. If more metallic material is removed from the tips the change can be greater in the resonance, especially at the L5 band.

In the example shown in FIG. 14 the tuning is preferably made such that the L1 band is tuned first before tuning of the L5 band. The removal of the metallic material can be provided, e.g., by scraping or etching material off. The cutouts can be produced in the patch element at the time of application thereof on the substrate.

Figure 15:
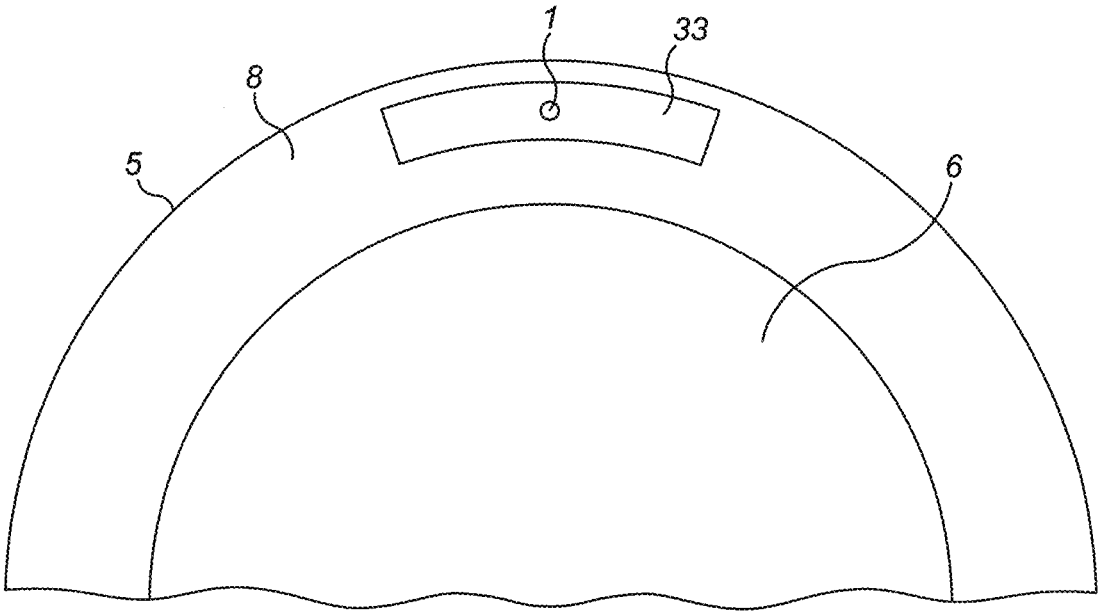
FIG. 15 shows a possible feeding element configuration.

FIG. 15 shows an example of a concave landing pad 33 attached to the feeding pin 1 on an uncovered area 8 of a substrate layer 5. In the example the shape of the landing pad 33 follows the shape of the edge of the patch element 6. It shall be appreciated that other shapes and arrangements of landing pads are also possible. For example, elliptical, rectangular, star or snowflake shapes and so on are possible.

Additive manufacturing technologies can be used for producing patch elements. In additive manufacturing processes physical objects can be formed e.g. by printing or spraying based on digital data. The additive manufacturing can be arranged to re-form a raw material by the addition of energy and positioning in a controlled manner. For example, pre-metallized high electric paste can be printed on a substrate to form a patch element of desired shape on the substrate. Thick firm pastes, for example thick firm pastes made of Ag with high conductivity are an example of a possible material suitable for the printing. Patch antennas can be produced to have only one metal Ag layer and no resistors.

Figure 16:
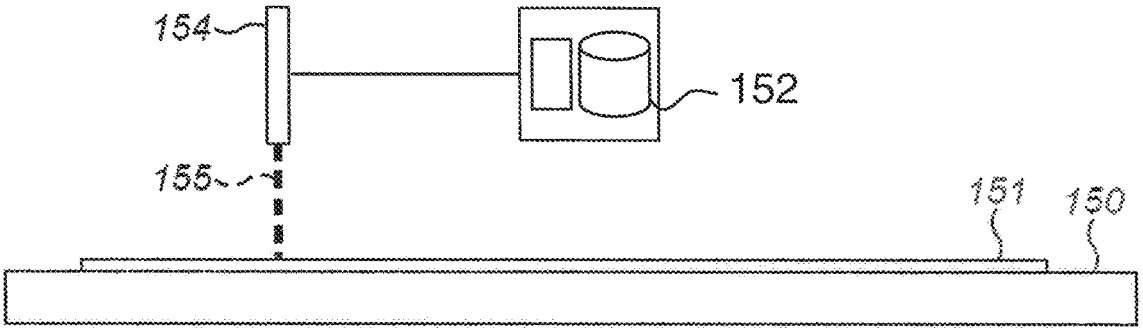
FIG. 16 shows an example of additive manufacturing of patch elements.

An example of printing of a patch element on a substrate is illustrated in FIG. 16 showing print head 154 laying down material 155 on a substrate 150. The material form a patch element 151 layer on the substrate. The print head 154 can be arranged to operate in e.g. a 5-axis or 7-axis control system. The operation of the printing head can be controlled by an appropriate combination of control apparatus and software. In the example the control is provided by a control unit 152 based on digital data. The additive process, such as operation and movement of the print head relative to the substrate, and/or movement of a support on which the printing takes place, can be controlled by one or more controller units.

A printing process where the material is laid in layers on a substrate is known as three dimensional (3D) printing. In 3D printing material is laid down by progressively adding material to form a product of desired shape, size and appearance. Screen printing is another example of a possible printing process. It is noted that a variety of printing processes are available, and new printing processes are being introduced.

A patch element may be completely printed. In other embodiments, depending on the requirements, only a part of a patch element is produced by printing.

The inventors have found that printing facilitates efficient manufacture of patch elements with complex geometries such as those as described above and shown in the figures. The printing technology can be applied to any type of patch antennae.

Figure 17:
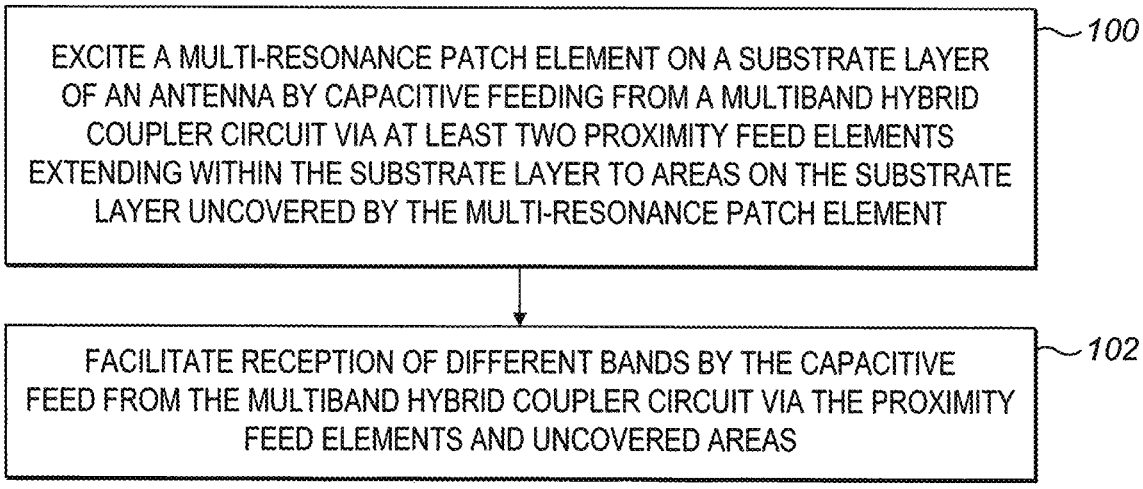
FIGS. 17 and 18 are flowcharts according to certain embodiments.

It has been found that printing pre-metallized paste can be used to efficiently produce smooth cornered patch elements directly on the substrate, such as the patch element 6 of FIG. 12C. FIG. 17 is a flowchart in accordance with a method for receiving radio frequency signals in multiple bands by a multiband microstrip patch antenna as explained above. In the method a multi-resonance patch element placed on a second surface of the substrate layer is excited at 100 by capacitive feeding of resonating energy from a multiband hybrid coupler circuit to the multi-resonance patch element. The feeding is provided via at least two proximity feed elements connected to the multiband hybrid coupler circuit and extending within the substrate layer from the first surface of the substrate layer to the second surface. Areas of the substrate layer where the at least two proximity feed elements extend to the second surface are left uncovered by the multi-resonance patch element. Simultaneous reception of different bands by a microstrip patch antenna is enabled at 102 by the capacitive feed from the multiband hybrid coupler circuit.

Figure 18:
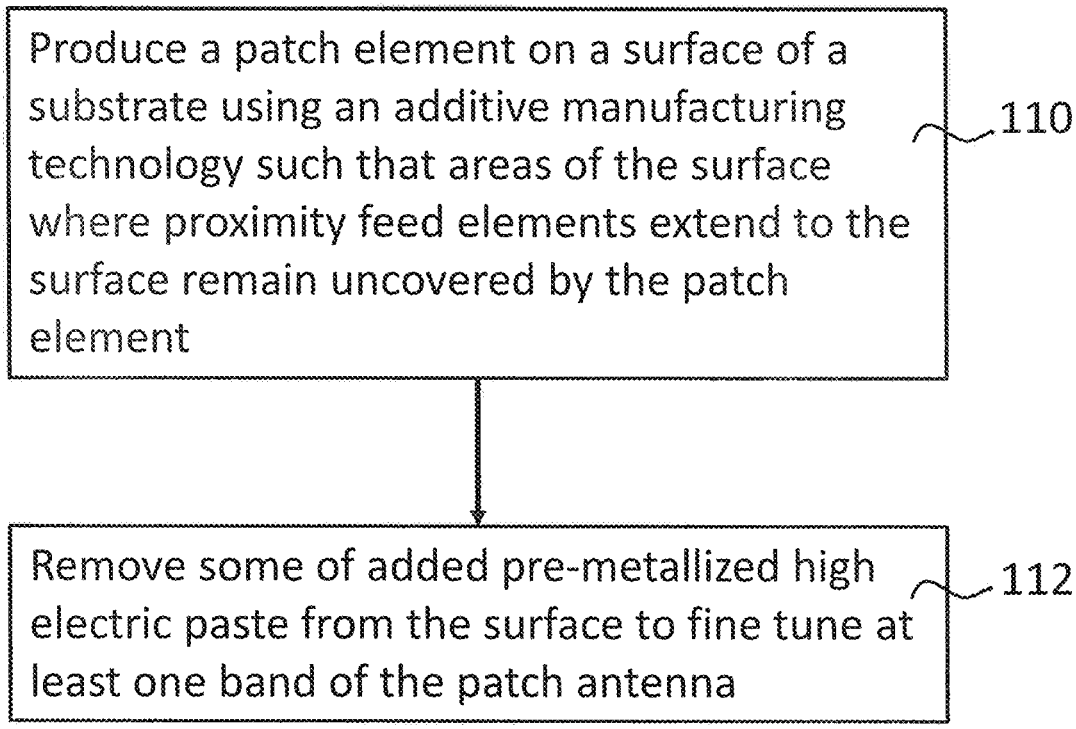

FIG. 18 is a flowchart in accordance with a method for manufacturing a patch antenna comprising a substrate having a first surface and a second surface, a base element on the first surface of the substrate layer, a patch element on the second surface of the substrate, and at least two proximity feed elements extending from within the substrate. The patch element can comprise a pattern of outward extending resonance formations. In the method the patch element is produced at 110 on the second surface of the substrate using a printing manufacturing technology such that areas of the second surface where the at least two proximity feed elements extend to the second surface are not covered by the finished patch element.

The antenna may be a multiband patch antenna as described above or any other patch antenna.

At least a part of the patch element may be produced by printing pre-metallized high electric paste, for example thick film paste, on the second surface. The printing may be provided such that the uncovered areas are produced by the printing process, by leaving the areas unprinted. In some applications printed material may be removed from at least one location to provide at least some of the uncovered areas, and-/or tuning areas.

The method may further comprise removing at 112 some of the added pre-metallized high electric paste from the second surface to fine tune at least one band of a multiband patch antenna.

A multiband patch antenna can be configured such that it covers bands e.g. in ranges of 1525 MHz to 1606 MHz and 1197 MHz to 1249 MHz frequencies. This covers a number of GNSS systems (generally within 1575 to 1606 MHz), for example those operating on L1 (1575.42 MHz), L2 (1227 MHz & 1242-1249 MHz), L5 (split to L5a 1176 MHz and L5b 1207 MHz) and L6 (1278 MHz) carrier frequencies. Particular examples of navigation systems include those known by names GPS, GLONASS, Galileo, Beiduo, Inmarsat, Sapcorda, and regional navigation and/or augmentation systems such as Egnos, WAAS, MSAS, QZSS, and IRNSS. Other examples include commercial RTK-correction services, either regional or global (L-band close to L1 frequency 1525 . . . 1555 MHz) and QZSS/LEX on L6. It is noted that these are only some of the current examples, and given only to illustrate and not anyhow limit the possible bands and frequencies. It shall also be appreciated that different combinations of bands can be provided and received by the herein disclosed multiband patch antenna, depending on the application and requirements.

Figure 19A:
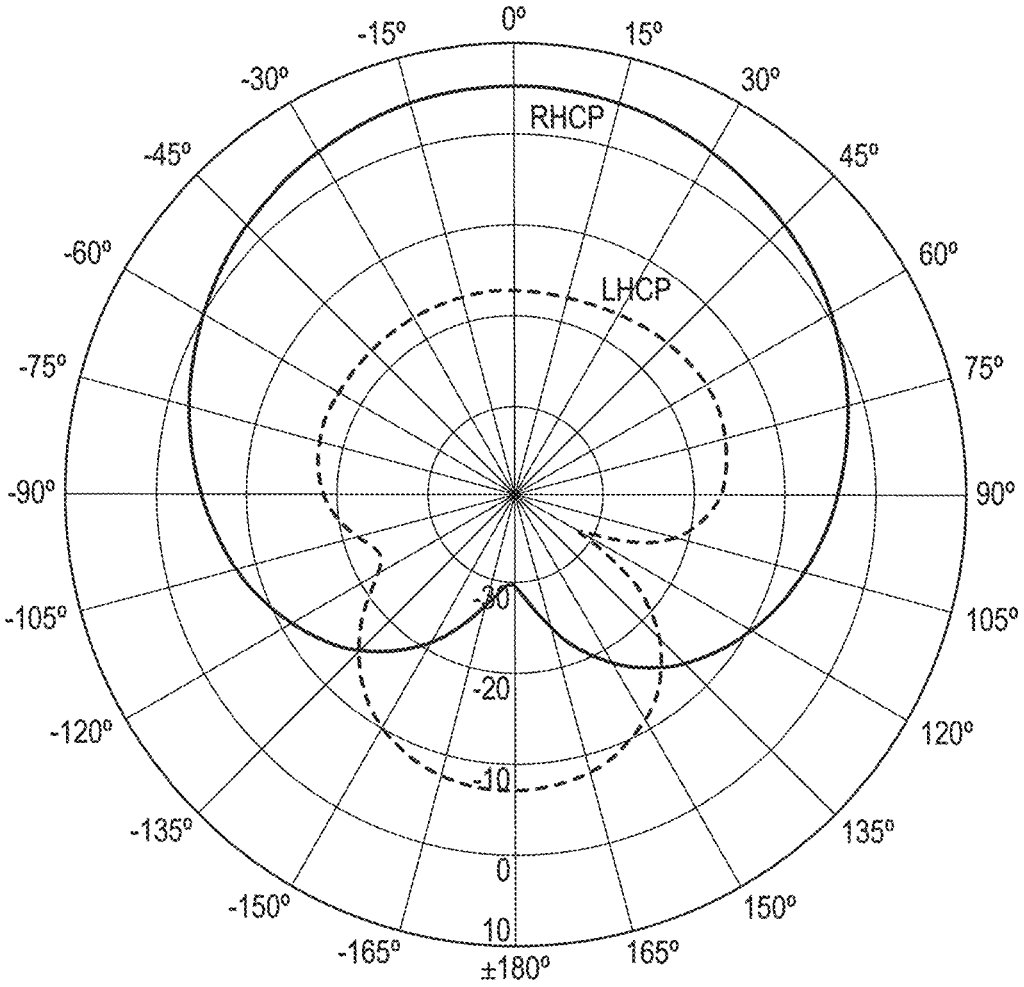
FIGS. 19A to 22 show simulation results for multiband patch antenna according to FIGS. 1 to 5.
Figure 19B:
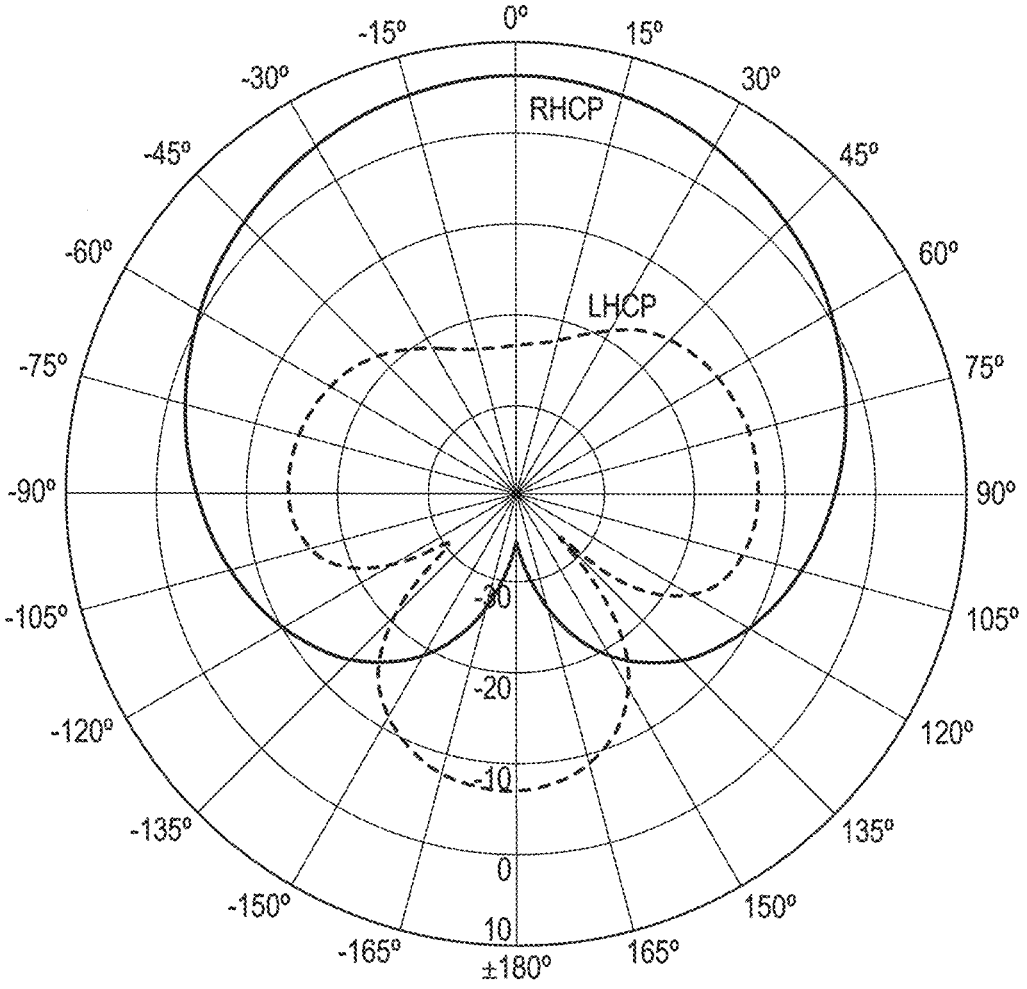

Various simulation results for the multi-band patch antenna of FIGS. 1-5 are shown in FIGS. 19A to 22 where FIGS. 19A and 19B show circular polarized patterns. The solid lines represent the RHCP realized gain, and the dashed lines the LHCP realized gain. Although FIGS. 19A and 19B show only the xz-plane, resulting plots for the yz-plane would be almost the same due to symmetry of the design. FIG. 19A shows the radiation pattern at L1, and FIG. 19B at L2. The RHCP patterns at both bands are symmetrical, and the LHCP components are low.

Figure 20:
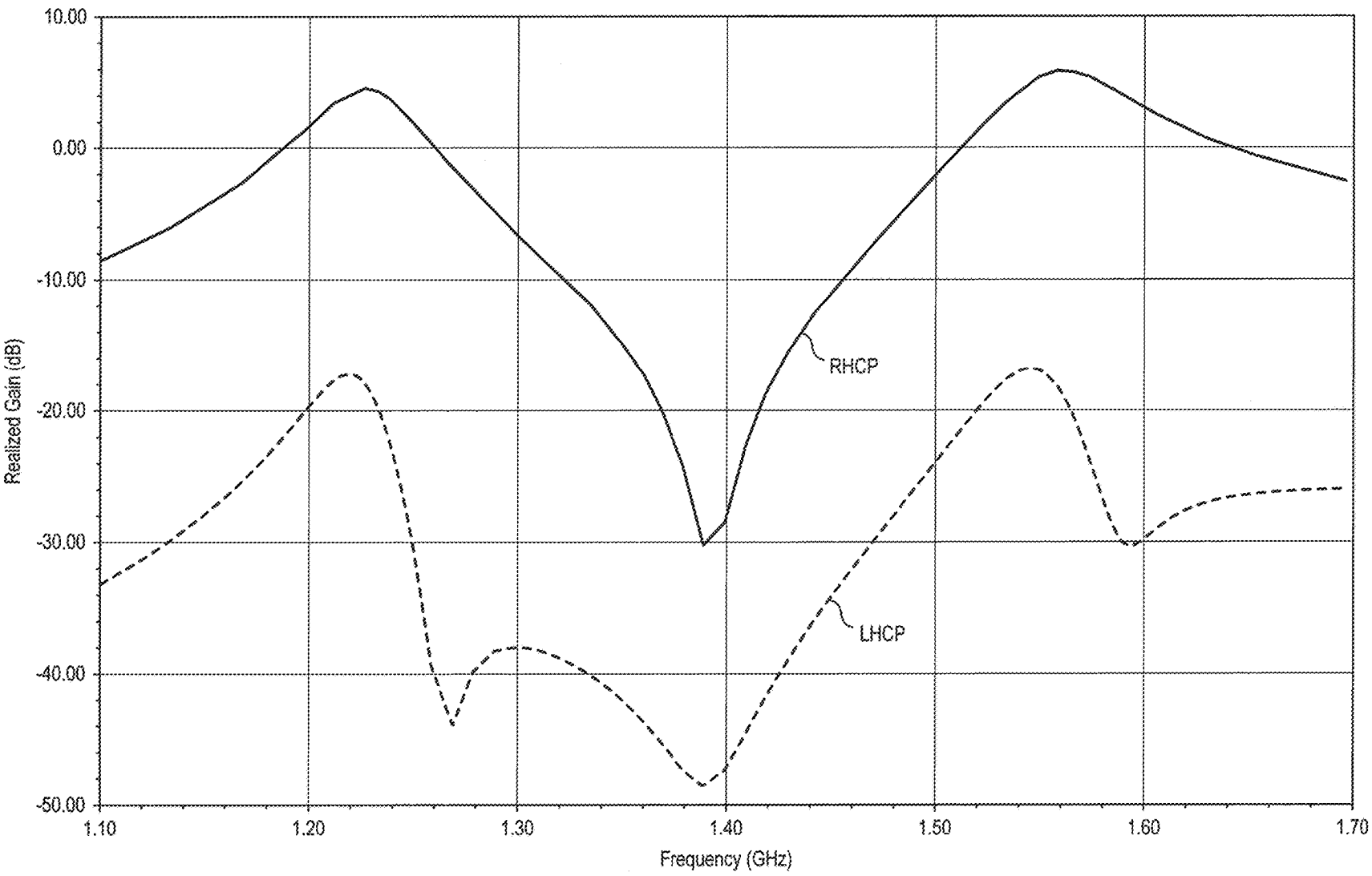

FIG. 20 shows in more detail the realized gain versus frequency of right-hand circular polarization (RHCP) and left-hand circular polarization (LHCP) towards the zenith (direction of maximum gain). The top line shows the realized RHCP gain, i.e. includes losses due to impedance mismatch. The lower curve shows the realized LHCP gain, which is typically 20 dB lower than the realized RHCP gain.

Figure 21:
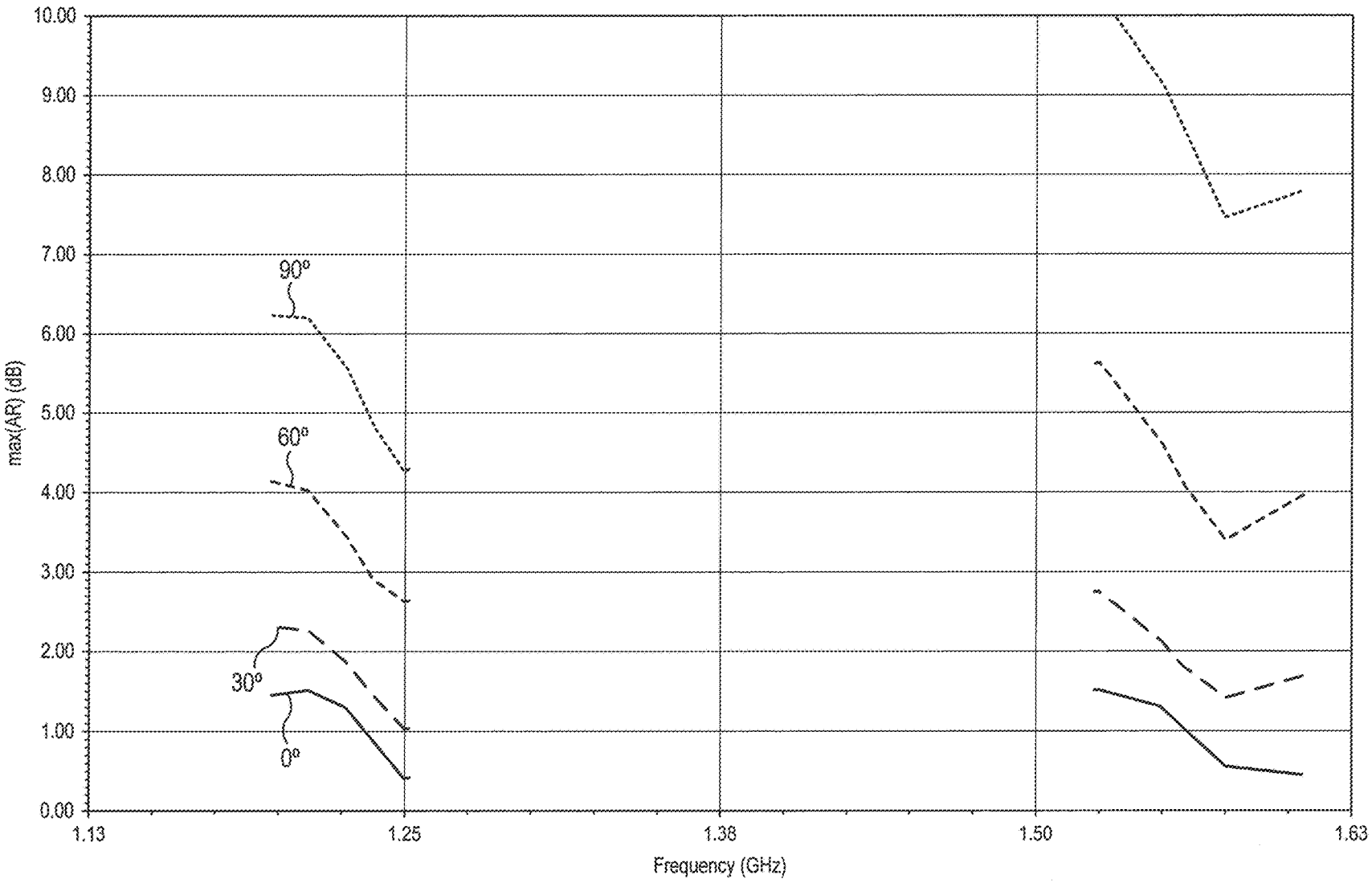

An axial ratio (AR) versus frequency simulation is shown in FIG. 21 for axial ratio values (from bottom curve to top curve) 0 (zenith), 30, 60 and 90 (horizon) degrees for two bands and a gap between 1249 MHz and 1525 MHz. This is a measure of the circularity of the RHCP wave i.e. the AR specifies the circularity of the polarization. In this measure lower values are considered better, zero meaning a full circle. A circle would give an AR of 1 (0 dB), and as that value goes up the RCHP wave becomes less circular. The plots show the maximum AR over azimuth at different elevations over frequency. At zenith the AR is below 2 dB, and remains below 3 dB at an elevation from zenith of 30°. This can vary over frequency and over direction (both elevation and azimuth). Due to the axial-symmetric design, the curve can be quite flat along azimuth, and hence the plot shows the maximum across azimuth. Typically the AR (or polarization purity) can degrade at lower elevation angles. To keep the figure reasonably simple the max AR is plotted only at 0 degrees (zenith), and then in 30 degree steps to 90 degrees (horizon). Typically, these values would only be given at zenith but for completeness FIG. 21 also shows the data at the less ideal directions. Although the commonly accepted expectation is the AR to be poor closer to the horizon, it is noteworthy that even when in 30 degrees from the zenith a good performance can be shown.

Figure 22:
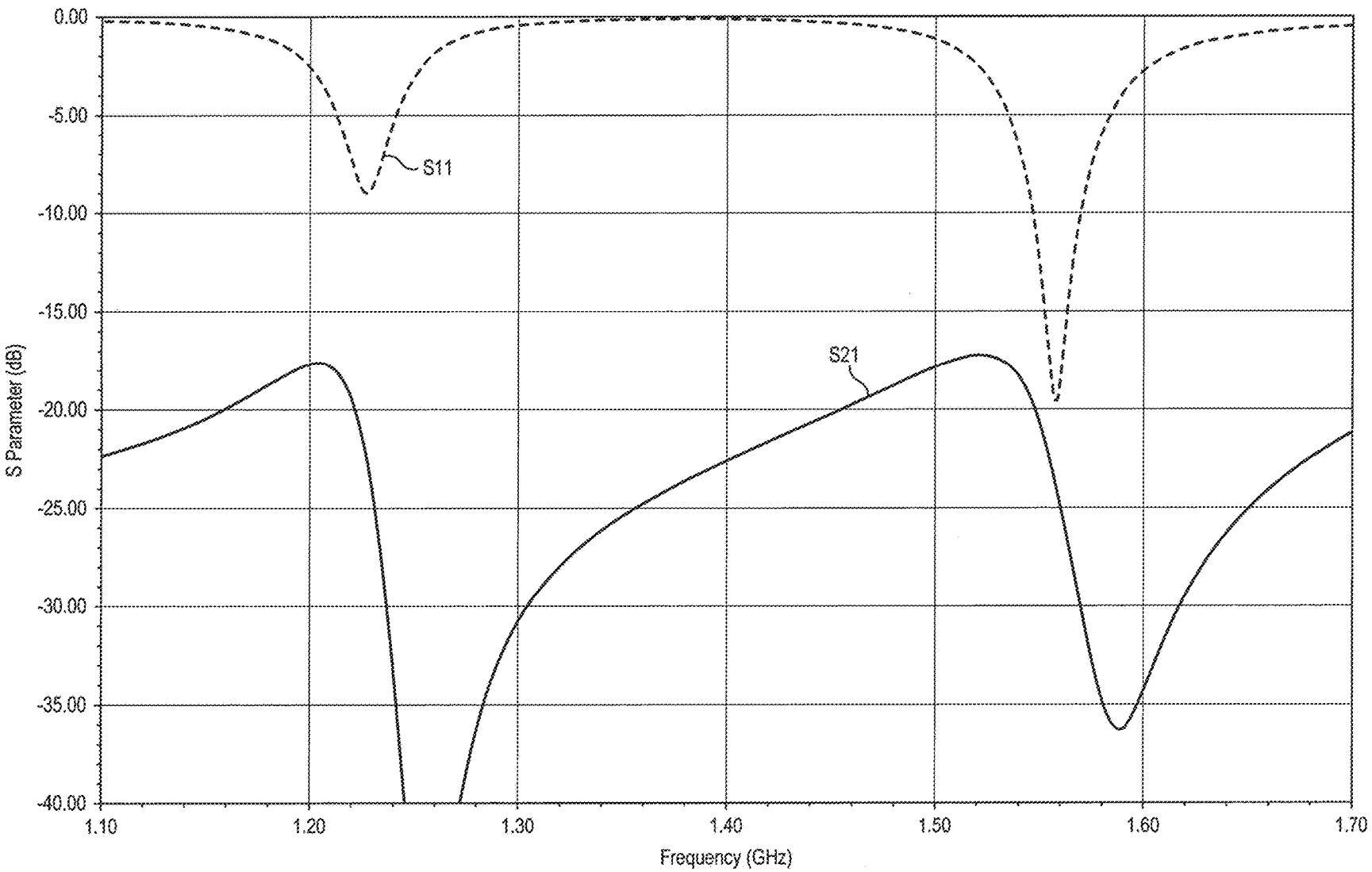

FIG. 22 shows the S-parameters in dB over frequency of feed port 1. The upper curve is the S11 parameter or reflection coefficient at feed 1, and the lower curve is the S21 parameter or transmission coefficient from feed 2 to feed 1. The upper/S11 curve shows the two resonances with a good match in the upper L1+RTK L-band, and a moderate match in the L2 band. The transmission coefficient is suitably quite low, mostly below −20 dB.

The herein disclosed multi-resonance patch antenna with through-feed pins can provide various advantageous features. For example, the antenna can provide sufficient bandwidth to cover L1 and RTK L-band (1525 MHz to 1606 MHz) with one resonance, and L2 (1197 MHz to 1249 MHz) with a second resonance. There may be no need for costly high-dielectric substrate to achieve this. Single substrate can be used without need of assembling multiple substrate materials of a stacked multi-band patch antenna. Compact low-cost antennas may be provided to support dual-band (e.g. L1/L2 or L1/L5) and RTK L-band corrections. The antenna is scalable for high-volume low-cost production. Compact antennas can be arranged in arrays of various formations.

It is noted that the above non-limiting examples are given in relation to current satellite navigation systems. However, similar features can be used in any frequency bands allocated for navigation systems. The invention may also be advantageously used in other than satellite based navigation systems, and also in other applications than navigation systems. For example, phase array patch antennas may be configured and used as described herein.

While certain aspects of the invention may be illustrated and described as block diagrams, flow charts, or using some other schematic pictorial representation, it is well understood that these blocks, apparatus, systems, techniques and methods described herein may be implemented at least in part in, as non-limiting examples, hardware, software, firmware, special purpose circuits or logic, general purpose hardware or controller or other computing devices, or some combination thereof.

The foregoing description provides by way of exemplary and non-limiting examples a full and informative description of exemplary embodiments of the invention. However, various modifications and adaptations may become apparent to those skilled in the relevant arts in view of the foregoing description, when read in conjunction with the accompanying drawings and the appended claims. All such and similar modifications of the teachings of this invention will still fall within the spirit and scope of this invention.

The invention claimed is:

1. A multiband patch antenna comprising:

a substrate layer having a first surface and a second surface, a base element on the first surface of the substrate layer, a multi-resonance patch element on the second surface of the substrate layer, the multi-resonance patch element comprising a pattern of outward extending resonance formations, and at least two proximity feed elements configured for connection to a multiband hybrid coupler circuit and extending within the substrate layer from the first surface to the second surface, wherein areas on the second surface where the at least two proximity feed elements extend to the second surface are uncovered by the multi-resonance patch element.

2. The multiband patch antenna according to claim 1, wherein the multi-resonance patch element is symmetrically shaped to cover only a part of the second surface to provide the at least one uncovered area where the at least two proximity feed elements extend to the second surface.

3. The multiband patch antenna according to claim 1, wherein the multi-resonance patch element has a surface area that is smaller than the area of the second surface of the substrate layer such that resonant fields caused by the multi-resonance patch element are for the most part constrained within the substrate layer.

4. The multiband patch antenna according to claim 1, wherein the multi-resonance patch element comprises cut-outs that leave parts of the second surface uncovered.

5. The multiband patch antenna according to claim 4, wherein the periphery of the multi-resonance patch element substantially coincides with the periphery of the substrate element and the cut-outs provide uncovered areas within the periphery of the substrate element where the at least two proximity feed elements extend to the second surface.

6. The multiband patch antenna according to claim 1, wherein the substrate layer comprises a cylindrical or a rectangular substrate element of dielectric material.

7. The multiband patch antenna according to claim 6, comprising a circular multi-resonance patch element with a radius that is smaller than the radius of the cylindrical substrate element or smaller or the same as the length of the side of the rectangular substrate element thereby providing at least one uncovered area where the at least two proximity feed elements extend to the second surface.

8. The multiband patch antenna according to claim 1, wherein the substrate layer comprises ceramic material with relative permittivity from 9.2 to 20.0.

9. The multiband patch antenna according to claim 8, wherein the substrate layer comprises ceramic material with relative permittivity in the order of 9.5.

10. The multiband patch antenna according to claim 1, wherein the at least two proximity feed elements are located on lines extending between two outwardly extending formations of the multi-resonance patch element.

11. The multiband patch antenna according to claim 1, wherein the at least two proximity feed elements comprise pins and landing pads at the ends of the pins that extend to the second surface, wherein the landing pads have circular, elliptical, rectangular, and/or concave shape.

12. The multiband patch antenna according to claim 1, wherein the base element comprises a printed circuit board that provides the multiband hybrid coupler circuit.

13. The multiband patch antenna according to claim 1, wherein the multiband hybrid coupler circuit comprises a dual-band or a wideband hybrid coupler, a diplexer between different bands, at least one surface acoustic wave (SAW) filter, at least one low-noise amplifier (LNA) and a combiner.

14. The multiband patch antenna according to claim 1, configured to operate at least in two of L1, L2, L5a, L5b, L6, RTK-L, and L-band RTK correction service bands.

15. The multiband patch antenna according to claim 1, wherein the pattern of outward extending resonance formations comprise meandering lines that provide a star shaped formation and/or a snowflake shaped formation and/or arrow headed asterisk shaped formation.

16. The multiband patch antenna according to claim 1, wherein the multi-resonance patch element comprises at least one fine-tuning formation.

17. A method for receiving radio frequency signals in multiple bands by a multiband patch antenna comprising a substrate layer having a first surface and a second surface, the method comprising exciting a multi-resonance patch element on the second surface comprising a pattern of outward extending resonance formations by capacitive feeding of resonating energy to the multi-resonance patch element via at least two proximity feed elements connected to a multiband hybrid coupler circuit and extending within the substrate layer from the first surface of the substrate layer to the second surface, wherein areas of the multi-resonance patch element on the second surface where the at least two proximity feed elements extend to the second surface are uncovered by the multi-resonance patch element, and enabling simultaneous reception of different bands by the multiband hybrid coupler circuit.

* * * * *